US005162634A

United States Patent [19]

Kusaka et al.

[11] Patent Number: 5,162,634

[45] Date of Patent: Nov. 10, 1992

[54] IMAGE FIXING APPARATUS

[75] Inventors: Kensaku Kusaka, Kawasaki; Yoshihiko Suzuki, Tokyo; Shigeo Kimura, Yokohama; Atsushi Hosoi, Kawasaki; Hiroyuki Adachi, Tokyo; Masahide Kinoshita, Yokohama; Hidekazu Maruta, Tokyo; Akira Yamamoto, Tokyo; Ikuko Naruse, Tokyo, all of Japan

[73] Assignee: Canon Kabushiki Kaisha, Tokyo, Japan

[21] Appl. No.: 813,912

[22] Filed: Dec. 27, 1991

Related U.S. Application Data

[63] Continuation-in-part of Ser. No. 496,957, Mar. 21, 1990, and a continuation-in-part of Ser. No. 444,802, Dec. 1, 1989, and a continuation-in-part of Ser. No. 789,907, Nov. 12, 1991, which is a continuation of Ser. No. 430,437, Nov. 2, 1989, Pat. No. 5,083,168.

[30] Foreign Application Priority Data

| | | | |
|---|---|---|---|
| Nov. 15, 1988 | [JP] | Japan | 63-287940 |
| Nov. 25, 1988 | [JP] | Japan | 63-297369 |
| Dec. 6, 1988 | [JP] | Japan | 63-308662 |
| Dec. 12, 1988 | [JP] | Japan | 63-313272 |
| Dec. 12, 1988 | [JP] | Japan | 63-313273 |
| Dec. 12, 1988 | [JP] | Japan | 63-313276 |
| Dec. 12, 1988 | [JP] | Japan | 63-313277 |
| Dec. 13, 1988 | [JP] | Japan | 63-315333 |
| Mar. 28, 1989 | [JP] | Japan | 64-076253 |
| Jun. 22, 1989 | [JP] | Japan | 64-160271 |

[51] Int. Cl.[5] ..... G03G 15/20

[52] U.S. Cl. ..... 219/216; 219/546; 219/469; 219/482; 355/289; 355/290

[58] Field of Search ..... 219/216, 388, 201, 243, 219/469, 482, 520, 521, 536, 552, 553, 546; 355/285, 289, 290, 295, 282; 432/60, 59

[56] References Cited

U.S. PATENT DOCUMENTS

| | | | |
|---|---|---|---|
| 3,810,735 | 5/1974 | Moser | 432/59 |
| 3,811,828 | 5/1974 | Ohta et al. | 219/216 |
| 4,034,189 | 7/1977 | Sakamaki et al. | 219/469 X |
| 4,566,779 | 1/1986 | Coli et al. . | |
| 4,575,619 | 3/1986 | Porzky | 219/546 X |
| 4,780,742 | 10/1988 | Takahashi et al. | 219/216 X |

OTHER PUBLICATIONS

Patent Abstracts of Japan, vol. 12, No. 276(P-737) [3123], Jul. 30, 1988.

*Primary Examiner*—Richard L. Moses

*Attorney, Agent, or Firm*—Fitzpatrick, Cella, Harper & Scinto

[57] ABSTRACT

An image heating apparatus includes a heater having a heating surface; a base member for supporting said heater, said base member having an edge; a holder for supporting said base member; a film movable with a recording material in sliding contact with the heating surface; wherein said holder has a rounded projection for preventing contact of said film with the edge.

76 Claims, 22 Drawing Sheets

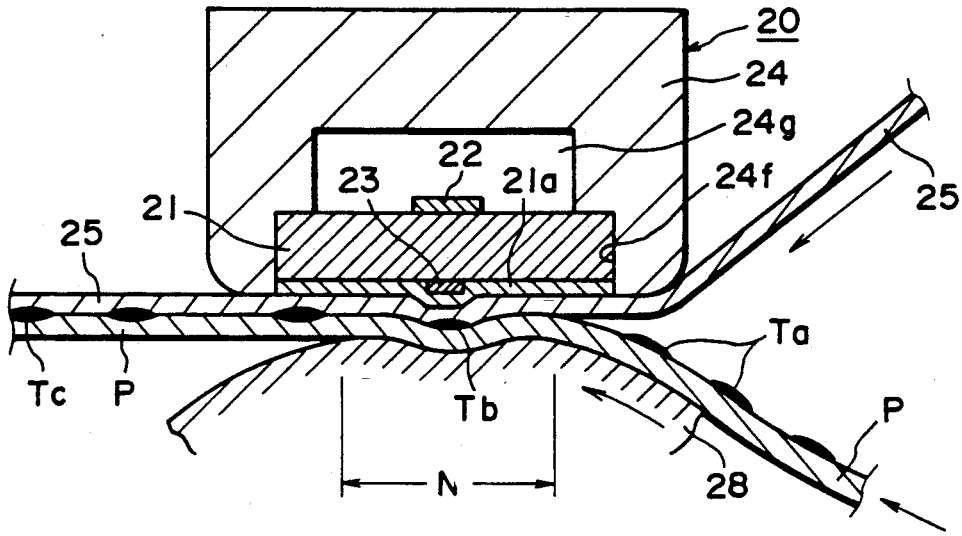
FIG. 15
FIG. 16A
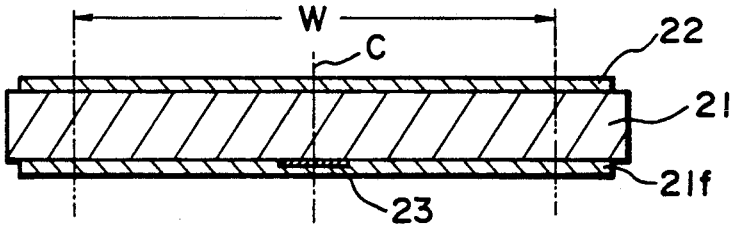
FIG. 16B
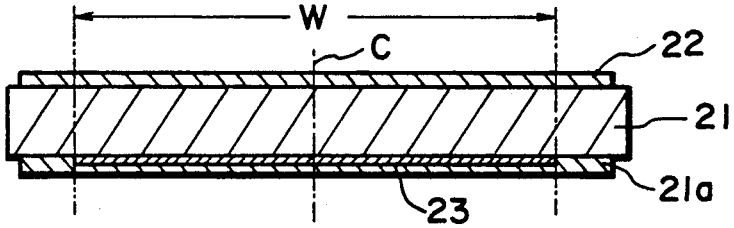
FIG. 16C
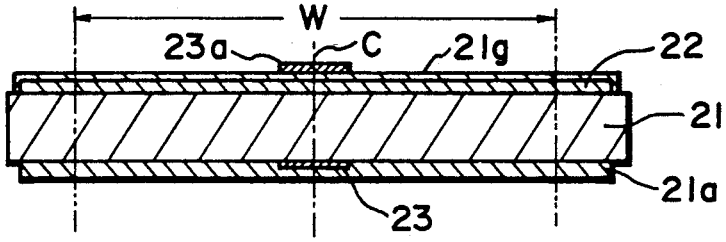

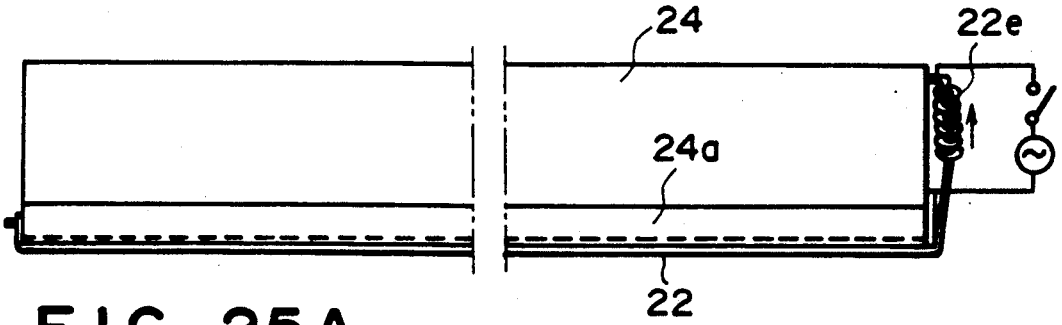
FIG. 25A
FIG. 25B
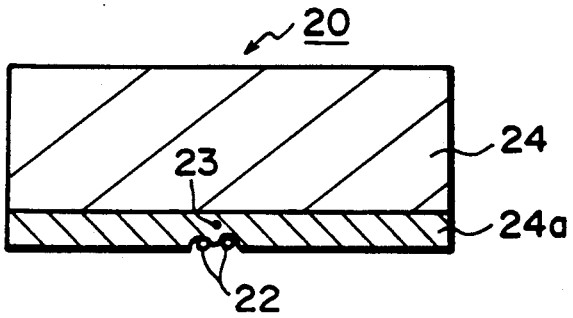
FIG. 26
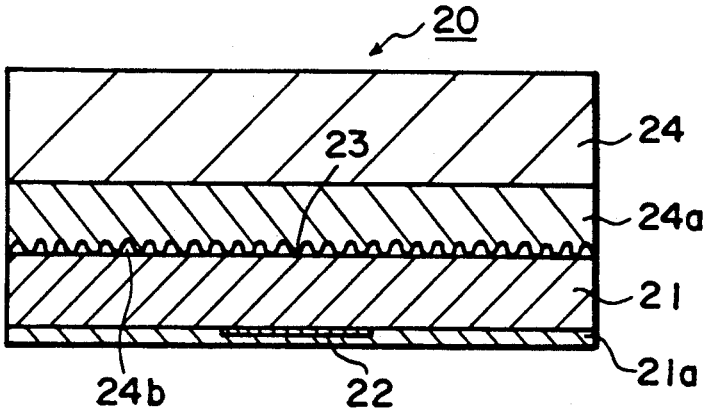
FIG. 27
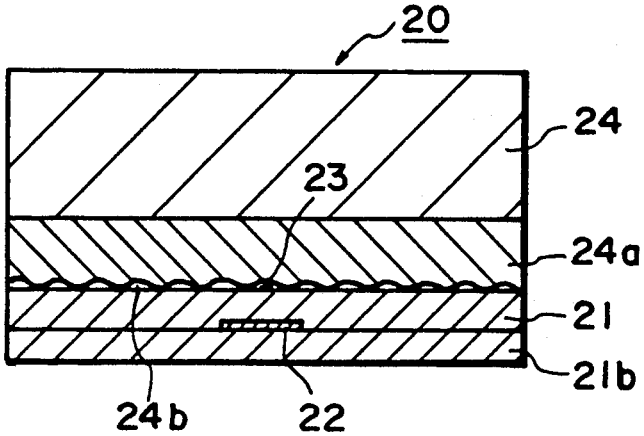

IMAGE FIXING APPARATUS

This is a continuation-in-part application based on the following United States Patent Applications:

1) Ser. No. 496,957, filed Mar. 21, 1990, and currently pending;
2) Ser. No. 444,802, filed Dec. 1, 1989, and currently pending; and
3) Ser. No. 789,907, filed Nov. 12, 1991, and currently pending, which is a continuation application under 37 C.F.R. §1.60 of Ser. No. 430,437, filed Nov. 2, 1989, now U.S. Pat. No. 5,083,168.

FIELD OF THE INVENTION AND RELATED ART

The present invention relates to an image fixing apparatus usable with an image forming apparatus such as a copying machine, a laser beam printer, a microfilm reader/printer, a facsimile machine, a recorder or an image display apparatus, for heat-fixing into a permanent fixed image a heat-fixable unfixed toner image which corresponds to object image information and which has been directly or indirectly (image transfer type) on a recording material such as electro-fax sheet, a transfer material sheet, an electrostatic recording sheet, a printing sheet or the like.

In a widely used conventional image fixing apparatus wherein the toner image is fixed on the recording medium supporting an unfixed toner image, the recording material is passed through a nip formed between a heating roller maintained at a predetermined temperature and a pressing or back-up roller having an elastic layer and press-contacted to the heating roller.

However, the heating-roller type fixing system involves a problem that the warming up period until the surface of the heating roller reaches a predetermined temperature is long.

In order to solve this problem, U.S. Ser. No. 206,767 proposes a novel image fixing apparatus wherein the toner image is fused using a small thermal capacity heater and an image fixing film slidable relative to the heater. This fixing apparatus comprises a heat generating resistor on a low thermal capacity substrate.

In such an apparatus, it is desirable to thermally indicate the heater to concentrate the heat on the fixing nip. If the heater base is of ceramic material such as alumina, sharp edges remain because of difficult machining nature.

When the base plate is made of ceramic material such as alumina, it is difficult to smoothly round the edge portion of the ceramic base plate. The edge of the heater is particularly important.

It is possible that when a part of the film is partly creased or partly projected during passage by the edge portion, it can scrape the unfixed toner image on the recording material introduced into the fixing apparatus, with the result of disturbed image. The scraped toner can contaminate the film, the recording material and the pressing roller.

SUMMARY OF THE INVENTION

Accordingly, it is a principal object of the present invention to provide an image fixing apparatus wherein the fixing film can smoothly slide on a heater.

It is another object of the present invention to provide an image fixing apparatus wherein the heater can be used without rounding an edge of the heater.

It is a further object of the present invention to provide an image fixing apparatus wherein the fixing film can move without sliding contact with the edge.

It is further object of the present invention to provide an image heating apparatus in which to heat from the heater can be concentrated on the recording material.

It is further object of the present invention to provide an image heating apparatus wherein the heater is supported by a channel-like portion of an insulative holder.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 15 is a sectional view of an example of a heater.

FIGS. 16A, 16B and 16C show examples of temperature sensor positions of the heater.

FIGS. 25A and 25B are a side view and an enlarged sectional view of a heater in a further example.

FIGS. 26–29 are enlarged sectional views of further examples.

DESCRIPTION OF THE PREFERRED EMBODIMENTS

Figure 1:
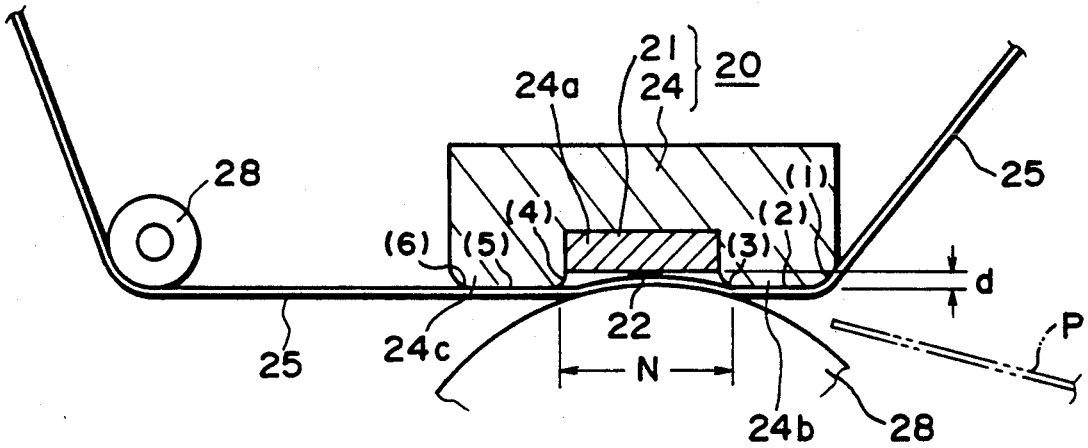
FIG. 1 is a partial sectional view of an image fixing apparatus according to an embodiment of the present invention.

The preferred embodiments of the present invention will be described in conjunction with the accompanying drawings wherein like reference numerals are assigned to the elements having the corresponding functions.

Figure 3:
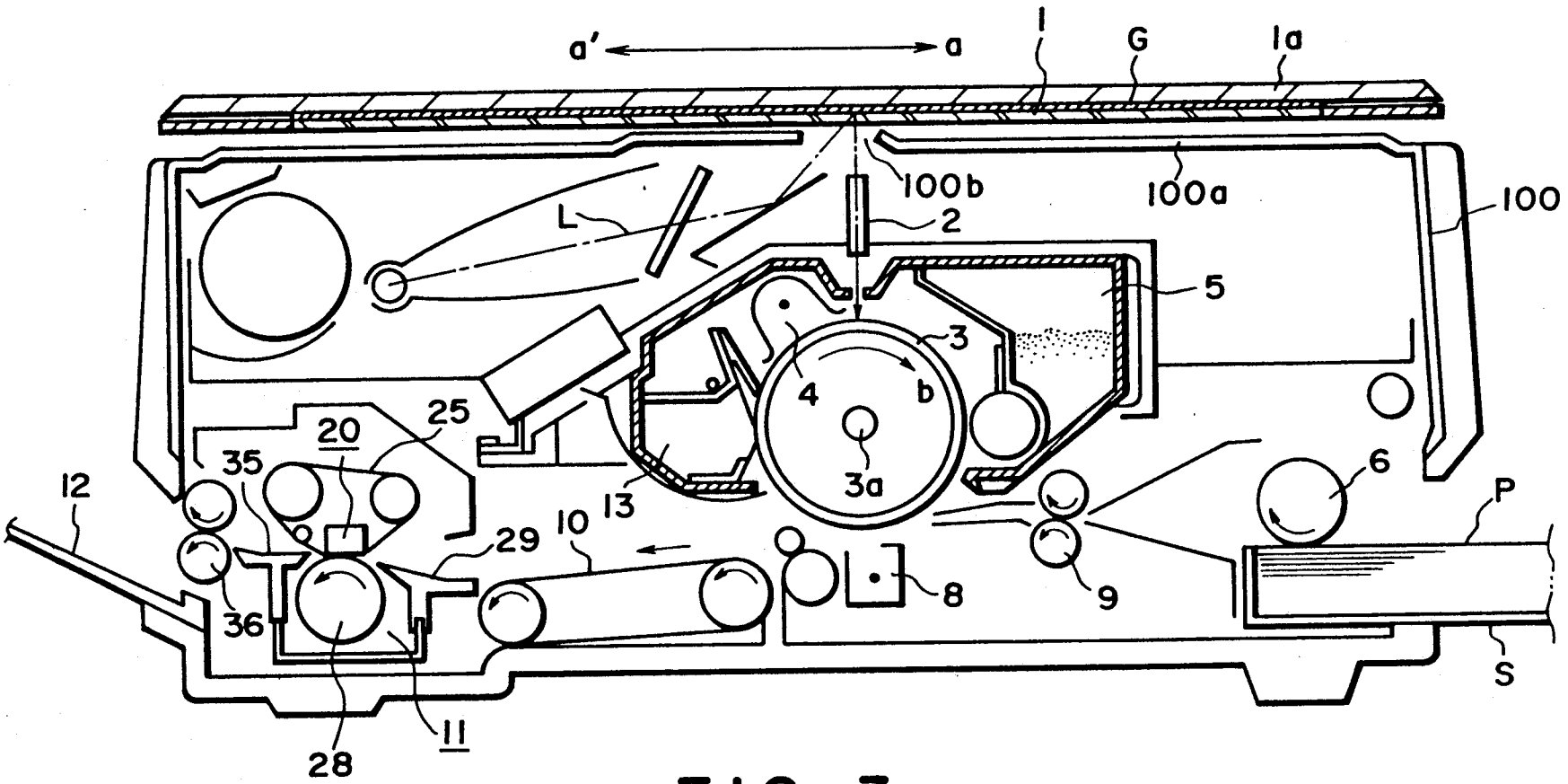
FIG. 3 is a sectional view of an image forming apparatus incorporating an image fixing device according to an embodiment of the present invention.

FIG. 3 is a sectional view of an image forming apparatus incorporating an image fixing device according to an embodiment of the present invention. The exemplary image forming apparatus is an electrophotographic copying apparatus wherein an original supporting platen is reciprocable, a rotatable drum is used, and an image is transferred therefrom.

The apparatus comprises a housing 100, a reciprocable original supporting platen 1 made of transparent member such as glass plate disposed on the top plate 100*a* of the housing 100, wherein the original supporting platen 1 is reciprocable rightwardly (a) and leftwardly (a') on the top plate 100*a* at predetermined speeds.

An original G is placed face down on the original supporting platen 1 at a predetermined placing reference, and is covered by an original cover 1*a*.

A slit opening 100*b* is formed on the top plate 100*a* extending in a direction perpendicular to the reciprocable movement direction of the original supporting platen (perpendicular to the sheet of the drawing). The slit constitute a part of the original illuminating system. The face-down image surface of the original G placed on the original supporting platen 1 passes by the slid opening 100*b* during the movement of the original supporting platen 1 toward the right side (a). During the passage, the light L of the lamp 7 illuminates the original G through the slit opening 100*b* and the transparent original supporting platen 1. The light reflected by the original is imaged on the surface of the photosensitive drum 3 through an array 2 of imaging elements having a short focus and a small diameter.

The photosensitive drum 3 is coated with a photosensitive layer such as zinc oxide photosensitive layer or an organic photoconductor photosensitive layer. It is rotatable about a central axis 3*a* at a predetermined peripheral speed in the clockwise direction (b). During the rotation, the photosensitive drum 3 is uniformly charged to a positive or negative polarity by a charger 4, and the uniformly charged surface is exposed to the image light of the original through the slit opening, so that an electrostatic latent image corresponding to the light image is sequentially formed on the surface of the photosensitive drum 3.

The electrostatic latent image is visualized into a toner image with heat-softening or -fusing resin or the like by the developing device 5, and the visualized toner image is conveyed to the image transfer station having the transfer discharger 8.

The transfer material sheets P are contained in a cassette S. The sheet is singled out from the cassette by rotation of a pick-up roller 6 and is fed to the photosensitive drum 3 in such a timed relationship that when the leading of the toner image formed portion on the drum 3 reaches the transfer discharger 8, the leading edge of the transfer sheet P reaches the position between the transfer discharger 8 and the photosensitive drum 3. By the transfer discharger 8, the toner image is sequentially transferred onto the fed sheet from the photosensitive drum 3.

The sheet having received the toner image is sequentially separated from the surface of the photosensitive drum 3 by an unshown separating means and is introduced by conveying device 10 to an image fixing apparatus 11, where the unfixed toner image is heat-fixed. Thereafter, it is discharged onto the discharge tray outside the apparatus as a final print (copy) by a guide 35 and discharging rollers 36.

On the other hand, the surface of the photosensitive drum 3 having been subjected to the toner image transfer operation is cleaned by the cleaning device 13 so that the residual toner or other contamination are removed to be prepared for the next image forming operation.

Referring to FIG. 1, the fixing apparatus 11 according to this embodiment will be described. Except for the heater 20, the fundamental structures thereof are similar to those of FIG. 4.

In operation, when an image formation start signal is generated in the image forming apparatus, the image forming operation starts by which unfixed visualized image (powdery toner image, in this embodiment) corresponding to the object image information is formed on the recording material. The recording material is conveyed to the image fixing apparatus 11 with the image bearing side facing up, and is introduced into the fixing apparatus along a guide. The leading edge of the recording material P is detected by a recording material detecting sensor (not shown) disposed in the recording material passage adjacent to the fixing apparatus 11, at a point of time slightly before it enters the fixing apparatus 11. In response to the detection signal thereof, the fixing film 25 in the form of an endless belt starts to rotate in the clockwise direction. The rotational driving speed for the fixing film is such that the peripheral speed thereof is substantially equal to the recording material P conveying speed to the fixing apparatus 11. The fixing film 25 rotates without crease or snaking movement. Also, the power supply control to the heat generating member 22 of the heater 21 of the heater assembly 20 is also started.

The recording material P enters the nip formed between the fixing film 25 and the pressing roller 28, so that the bottom surface of the fixing film 25 is contacted to the unfixed toner image with pressure, while it is being conveyed through the nip N together with the fixing film 25.

During the passage of the recording material P through the fixing nip N, the toner image supporting side of the recording material is effectively heated by the thermal energy provided by the heater 21 of the heater assembly 20 through the small thickness of the fixing film 25, by which the toner image Ta is fused into a toner image Tb which is adhered on the surface of the recording material P. The recording material P is separated from the fixing film 25 when it leaves the fixing nip N. At the time of the separation, the temperature of the fused toner Tb is lower than that at the position of the heat generating member 22, but it is still higher than the glass transition point of the toner, so that the toner Tb has sufficient rubber property, and therefore, the toner image supporting side of the recording material P at the time of the separating point does not follow the surface of the fixing film, and has proper surface roughness. The toner Tb is cooled down into a solidified image Tc with the proper surface roughness maintained. Therefore, the fixed toner image is not glossy, and therefore, the image quality is high.

Since the toner is sufficiently heated and fused by the heater, no low temperature offset occurs. In addition, the recording material is separated from the fixing film after the temperature of the toner sufficiently decreases, and therefore, no high temperature offset occurs.

The recording material P separated from the fixing film 25 is guided along the guide 35 to the discharging rollers 36, during which the temperature of the toner Tb higher than the glass transition point decreases spontaneously down below the glass transition point, and therefore, is solidified into a solid image Tc. The recording material P now having the recorded image information is discharged onto the discharging tray 12.

The power supply control to the heat generating element 22 of the heater 21 is stopped at the time when a predetermined timer period elapses, the timer period being determined on the basis of the time required from the sensor detecting the trailing edge of the recording material P to the trailing edge thereof passing through the fixing nip N. Then, the rotation of the fixing film 25 is stopped. The fixing apparatus 11 is in the stand-by state until the leading edge of the next recording material is detected by the sensor.

In this embodiment, the glossiness of the image is prevented by separating the recording material from the film while the temperature of the toner is higher than the glass transition point. However, it is possible that the conveyance of the fixing film 25 together with the recording material P closely contacted thereto is continued after the recording material P passes through the fixing nip N, during which the heat of the softened or fused toner Tb is irradiated to cool the toner into a solidified toner Tc, and then it is sequentially separated from the fixing film 25 surface. In this case, the coagulation force of the toner solidified by the cooling step is very large, so that the toner behaves as a mass, and therefore, the adhesive or bonding force thereof to the recording material increases, while the adhesive force or bonding force to the fixing film decreases significantly. Since the toner is pressed by the pressing member when it is heated, softened or fused, at least a part of the toner constituting the image is soaked into the surface layer of the recording material, and the anchoring effect by the cooling and the solidification of the soaked portion is effective to increase the adhesive or bonding force of the toner to the recording material. As a result, the portion of the recording material in which the image has been fixed is easily and sequentially separated from the fixing film without production of the toner offset to the fixing film.

In this case, the image becomes glossy, and therefore, is usable when the glossiness is desired.

As will be understood, the temperature of the heater 21 is instantaneously raised to a fixable temperature (quick start), upon power supply to the heat generating element **21*b*, and therefore, the preliminary heating to the heater in which the temperature of the heater is raised beforehand is not required. Also, the heat transfer to the pressing roller 22 during the non-image-fixing operation is small. During the fixing operation, the fixing film, the toner image and the recording material are in the fixing nip N between the heater 21 and the pressing roller 28, and in addition, the heat generating period is short with the result of steep temperature gradient, by which the pressing roller 28** is not easily raised in temperature. The temperature of the pressing roller is maintained at a level lower than the fusing point of the toner even when the image forming operation is continuously performed in a practical manner.

In the apparatus having this structure, the toner image made of heat-fusible toner on the recording material P is first heated and fused by the heat generating member through the fixing film 25, and particularly, the surface portion thereof is completely softened and fused. At this time, the pressing roller 23 establishes close contact between the heater, the fixing film, the toner image and the recording material, so that the heat transfer is efficient. Therefore, the toner image can be efficiently heated and fused with the heating of the recording material P minimized. Particularly by limiting the power supply heat generating period, the energy consumption can be saved.

The size of the heater may be small, and therefore, the thermal capacity thereof may be small. For those reasons, it is not necessary to raise the temperature of the heater beforehand, so that the power consumption during the non-image formation can be minimized, in addition, the temperature rise in the apparatus can be prevented.

The description will be now made as to the fixing film used in this embodiment. The fixing film 25 is made of a thin film having good heat-resistive properties and having good parting properties with respect to the visualizing agent (toner). Where it is in the form of an endless belt repeatedly used, the durability thereof against the repeated use is to be high.

In order to reduce the thermal capacity for the purpose of accomplishing the quickly startable apparatus, the thickness thereof is preferably not more than 100 microns, further preferably not more than 40 microns. It may be a single layer film of a heat resistive resin such as PI (polyimide), PEI (polyetherimide), PES, PFA (copolymer of tetrafluoroethylene-perfluoroalkylvinylether), or it may be a multi-layer film including a 20 microns thickness base film coated with a parting layer of 10 microns at least on the side contactable to the recording material, the coating being made of PTFE resin (tetrafluoroethylene resin), PFA or another fluorinated resin added by electrically conductive material.

The pressing roller 28 has a rubber elastic layer made of silicone rubber having a good parting property. The pressing roller 28 is pressed to the bottom surface of the heater assembly 20 under a total pressure of 4–7 kg by an unshown urging means through the fixing film 25 interposed therebetween. The pressing roller 28 rotates following the movement of the fixing film 25, or it is driven at the peripheral speed substantially equal to the movement speed of the film 25.

The fixing nip N is formed by the pressing of the pressing roller 28 toward the bottom surface of the heater assembly 20. The width of the heater 21 is within the width of the fixing nip N.

The heater assembly 20 will be described in detail. The heater assembly 20 comprises a low thermal capacity linear heater and a supporting member 22 for fixedly supporting the heater. The heater includes a substrate 21 having a low thermal capacity, a high heat-resistivity and a high thermal conductivity, more particularly, an elongated alumina substrate having a thickness of 1 mm, a width of 10 mm and a length of 240 mm, and a heat generating element 22 on one side of the substrate, more particularly, heat generating resistor material such as silver-palladium or the like applied in a width of 1 mm by screen printing, for example, along the length of the substrate at substantially the center of the width of the substrate.

At a side of the substrate 21 opposite from the side having the heat generating resistor is provided with a temperature detecting element. The power supply to the heat generating resistor material is controlled so that the temperature detecting element detects a constant temperature.

The supporting member 22 for fixedly supporting the heater is a molded heat-resistive resin having a sufficient rigidity, high heat-resistivity and low thermal conductivity. Examples of usable materials are PET (polyethyleneterephthalate), bakelite, PPS (polyphenylenesulfide), PAI (polyimide amide), PI, PEEK (polyether ether ketone) resins.

In the bottom surface of the fixing film contactable side of the supporting member 24, a groove **24*a* is formed. The heater is extended along the length of the supporting member 24 substantially at the center of the width (measured in the direction of the fixing film movement). The groove 24*a* has a depth larger than the thickness of the heater. The heater is set in the groove 24*a* with the heat generating element 22 thereon facing outwardly, using double-sided adhesive tape or bonding agent or the like to fix it to the supporting member 24. The entire strength or rigidity of the heater assembly 20 is assured by the supporting member 24**.

The heater assembly 20 is mounted on the main assembly of the fixing apparatus by mounting an fixing the supporting member 24 on the mounting portion of the main assembly provided at a predetermined position thereof, with the bottom surface of the supporting member including the outer surface of the heater facing downwardly.

The fixing film 25 in the form of the endless belt rotates while the inside surface thereof slides on the bottom surface of the supporting member 24 including the outer surface of the heater of the heater assembly 20. The heat generating element 22 of the heater generates heat when it is supplied with electric power through the power supply electrodes connected to the longitudinal opposite ends thereof. The heater sinks in the groove **24*a*, so that the portions 24*b* and 24*c* of the supporting member 24** sandwiching the heater in the direction of the fixing film travel is outside the outer surface of the heater, in other words, a stepped portion d is formed in connection with the outer surface of the heater. The height of the step d is preferably 0.1–2 mm.

The portions **24*b* and 24*c* of the supporting member includes portions (1), (2), (3), (4), (5) and (6), as shown in FIG. 1 the corners of the portions are rounded with radia R=0.2–5 mm into rounded portions (1), (3), (4) and (6). The surface roughness of the surface portions (2) and (5) and the rounded portions (1), (3), (4) and (6**) is not more than 3.2 S, the surfaces are smooth.

In this manner, projections toward the recording material side beyond the outer surface of the heater are provided for guiding the film toward the recording material side at the upstream and downstream of the heater with respect to the movement direction of the film, by which the film does not slide on the edge of the heater.

Therefore, the heater can be used without rounding its edges. This permits to use poor machinability material such as the ceramic material for the heater. The projections are made by the molding on the supporting member made of resin having excellent machinability or productivity. Because of this, the processing and assembling steps are simple without the necessity of adding a process step.

In the manner described above, the damage or wearing of the inside surface of the film is prevented, so that the service life of the film is significantly increased. In addition, the scraping of the unfixed toner image and the image disturbance on the recording material to be subjected to the image fixing operation, due to the presence of the edges of the heater or the supporting member, are prevented, and in addition, the possible contamination of the film, the pressing member and the recording material by the scraped toner is also prevented.

Furthermore, the stability in the travel of the film is increased, and the stability and reliability of the fixing operation is improved.

Figure 2:
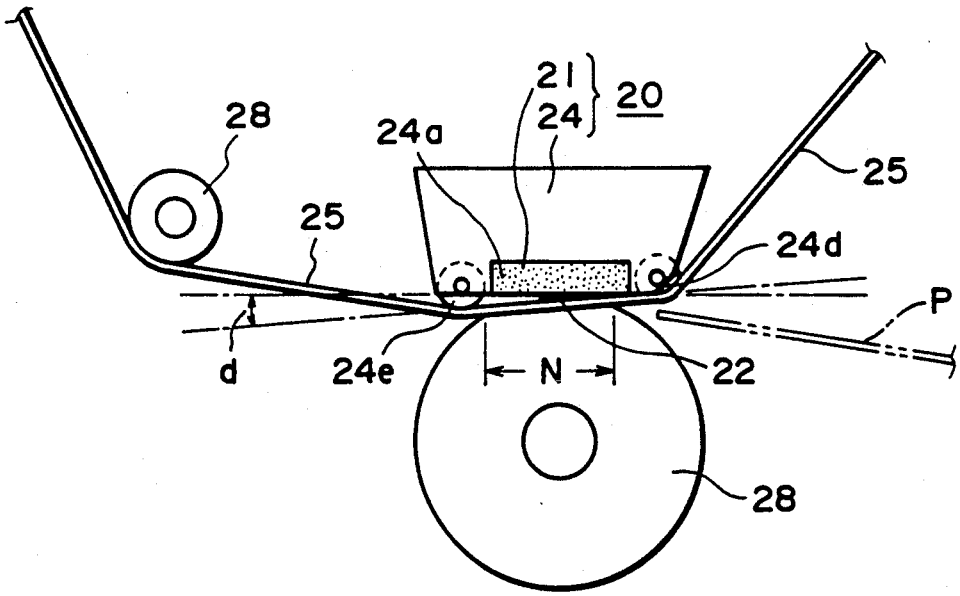
FIG. 2 is a partial sectional view of an image fixing apparatus according to another embodiment of the present invention.

Referring to FIG. 2, another embodiment of the present invention will be described. In this embodiment smoothly rotatable rollers **24*d* and 24*e*** for guiding the fixing film are provided on the supporting member upstream and downstream of the heater with respect to the movement of the film. Those rollers are projected outwardly beyond the outer surface of the heater to provide steps d with the outer surface of the heater. The height of the steps is 0.1–2 mm.

According to this embodiment, although the number of parts of the apparatus is increased due to the provision of the separate guiding rollers **22*d* and 22*e***, the force required for sliding the film is decreased because of the provision of the rotatable rollers, so that the required driving force for the film can be reduced.

Figure 5:
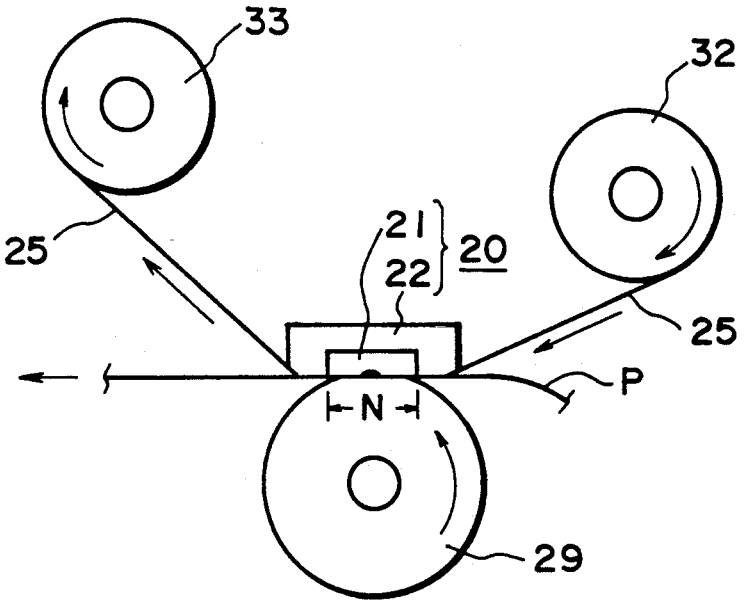

In this embodiment, the description has been made with respect to the endless fixing film. It is possible that a non-endless film is used, as shown in FIG. 5.

Where the fixing film 25 is not endless, a replaceable rolled film can be employed, wherein almost all of the fixing film 25 is taken up on the take-up reel 33 from the supply reel 32, a new roll of film is mounted (a wind-up and exchange type).

In this type, the thickness of the fixing film can be reduced substantially without regard to the durability of the fixing film, so that the power consumption can be reduced. For example, the fixing film in this type may be made of a less expensive material such as PET (polyester) film which is treated for heat-durability having a thickness of 12.5 microns or lower. As another alternative type, the used fixing film taken up on the take-up shaft can be rewound on the feeding shaft, or the take-up shaft and the feeding shaft are interchanged with each other to use the fixing film repeatedly, if the thermal deformation or thermal deterioration of the fixing film is not significant (a rewinding and repeatedly using type).

In this type, the fixing film is preferably made of a material exhibiting high heat-resistivity and mechanical strength, such as polyimide resin film having a thickness of 25 microns which is coated with a parting layer made of fluorinated resin or the like having a good parting properties to constitute a multi-layer film. A press-contact releasing mechanism is preferably provided to automatically release the press-contact between the heater and the pressing roller during the rewinding operation.

Where the fixing film is used repeatedly as in the rewinding and repeatedly using type and an endless belt type, a felt pad may be provided to clean the film surface and to apply a slider mount of parting agent such as silicone oil by impregnating the pad with the oil, by which the surface of the film is maintained clean and maintained in good parting property. Where the fixing film is treated with insulating fluorinated resin, electric charge is easily produced on the film, the electric charge disturbing the toner image. In that case, the fixing film may be rubbed with a discharging brush which is electrically grounded to discharge the film. On the contrary, the film may be electrically charged by applying a bias voltage to such a brush without grounding as long as the toner image is not disturbed. It is a possible measure against the image disturbance due to the electric charge to add carbon black or the like in the fixing film. The same means is applicable against the electric charge of the pressing roller. As a further alternative, anti-electrification agent may be applied or added. In any of the above endless belt type, the wind-up and exchange type and the rewinding and repeatedly using type, the fixing film may be in the form of a cartridge detachably mountable at a predetermined position in the fixing apparatus 11 to facilitate the fixing film exchanging operation.

The heater or the heat generating element 22 may be in the form of a ceramic chip array having a PTC characteristic. The power supply is not limited to the form of the pulsewise power supply but may be in the on-off power supply of AC or DC voltage.

Figure 4:
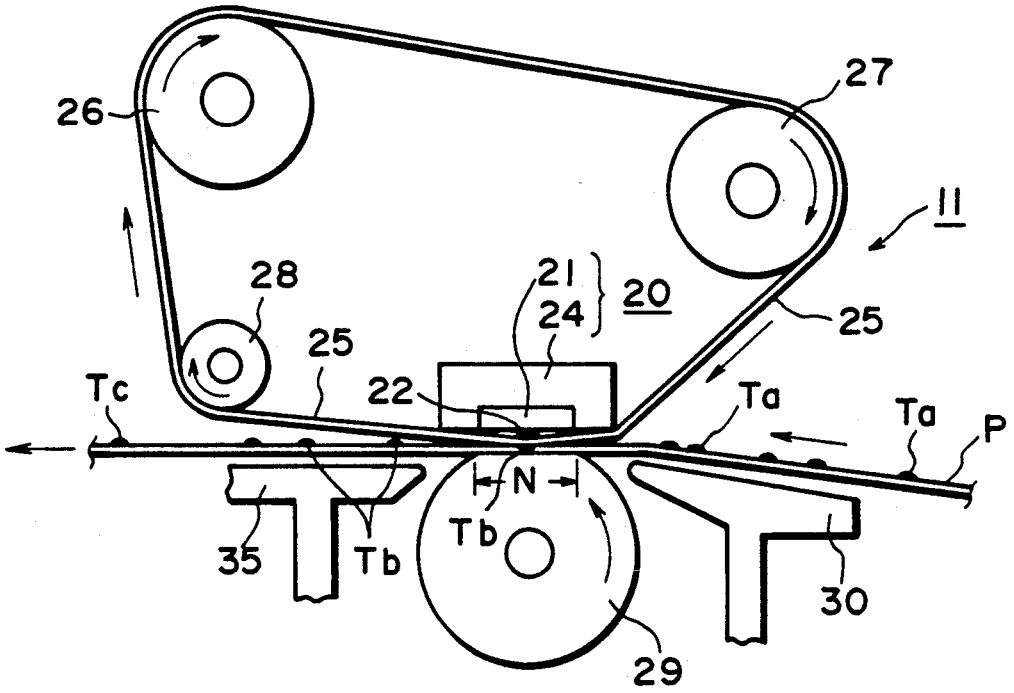
FIGS. 4–7 are sectional views of an image fixing apparatus according to an another embodiment of the present invention.

FIG. 4 is a sectional view of an apparatus according to a further embodiment.

The apparatus comprises a fixing film 25 in the form of an endless belt functioning as the above-described film. The film 25 is stretched around a driving roller 26, a follower roller 27, a heater assembly 20 below between the rollers and a guiding roller 28 below the driving roller 26. The follower roller 27 functions as a tension roller for the fixing film 25. The apparatus further comprises a pressing roller functioning as a pressing roller, and is effective to urge the fixing film 25 at its bottom surface to the heater assembly 20.

The heater assembly 20 includes as major components a linear heater having a low thermal capacity and a supporting member 24 for fixedly supporting the heater in thermal insulative relation. A heat generating resistor material 22 is mounted on a substrate 21*a* and generates heat upon electric power supply thereto. The heat generating resistor material 21*b* is instantaneously increased in its temperature by the electric power supply, and since the fixing film 25 has a small thickness, and therefore, has a low thermal capacity, the fixing operation is possible as soon as the power supply is started.

The fixing film 25 is not limited to the endless belt, but may be in the form of a rolled film, as shown in FIG. 5, wherein the film is rolled on a supply shaft 30 and the free end thereof is fixed to the take-up shaft 31 by way of the nip between the heater assembly and the pressing roller 29, so that the fixing film 25 is traveled from the supply shaft 30 side to the take-up shaft 32 side at the same speed as the recording material P conveying speed.

Figure 6:
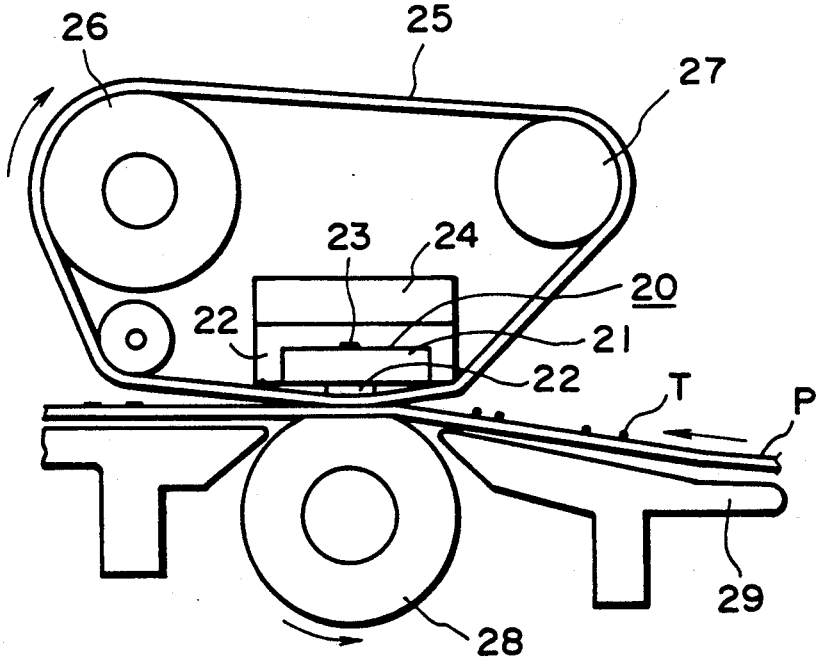

FIG. 6 is an enlarged cross-sectional view of the fixing device 11 according to a further embodiment of the present invention. A heating element 20 of the fixing device includes an alumina substrate 21 having a flat plate-like shape, and a wire-like resistor 22 whose heat capacity is small, which is coated on the alumina substrate 21. The resistor 22 is energized at the longitudinal two ends thereof by application of 100 V d.c. having a pulse-like form and a period of 20 msec. A temperature detecting element such as a thermistor is provided on the substrate 21. The pulse width of the waveform applied to the resistor 22 is varied in the range from 0.5 msec to 5 msec so that the temperature detected by the detecting element is kept at a predetermined value.

The heating element 20 whose energization is controlled in the manner described above is fixedly supported on the fixing device by a supporting member having a high rigidity such as steel with a heat-insulating supporting member 24 made of a heat-resistant resin such as PPS or polyamide being interposed therebetween. The heating element 20 is supported by a stay 25.

A fixing film 25 is conveyed under an adequate tension without any wrinkle generated in the film by a driving roller 26 and a driven roller 27 in the direction indicated by the arrow in a state wherein it is in contact with the heating element 20. The portion of the wire-like resistor 22 of the heating element 20 which slides against the fixing film 25 is covered by a protective layer made of a heat-resistant glass or a heat-resistant resin.

The fixing film 25 may be an endless film in which a releasing layer is coated in a thickness of 10 microns at least on the surface of a heat-resistant film of a thickness of 20 microns which makes contact with an image. The releasing layer may be made of a fluororesin, such as PTFE, PFA or FEP, to which a conductive material such as carbon black is added. The heat-resistant film may be made of a heat-resistant resin, such as polyimide (PI), polyetherimide (PEI), polyethersulfone (PES), perfluoroalkoxy (PFA) or polyketonesulfide (PKS). The thickness of the fixing film 26 is generally set to 100 microns or less, preferably, from 10 to 40 microns with heat-conductivity being taken into consideration.

A pressurizing roller 28 has an elastic layer which may be made of a rubber having an excellent releasing property, such as silicone rubber. The roller 29 is rotated during which time it presses against the heating element 20 through the fixing film 25 at a pressure of about 4 to 7 kg per the width of a recording material having an A4 size.

Unfixed toner T on the recording material P is led into the fixing portion by an inlet guide 30, where it is fixed to the recording material P by means of a heat. By supporting the heater in the channel-like portion of the heat insulative holder, the insulating effect is enhanced to concentrate the heat on the nip.

Figure 7:
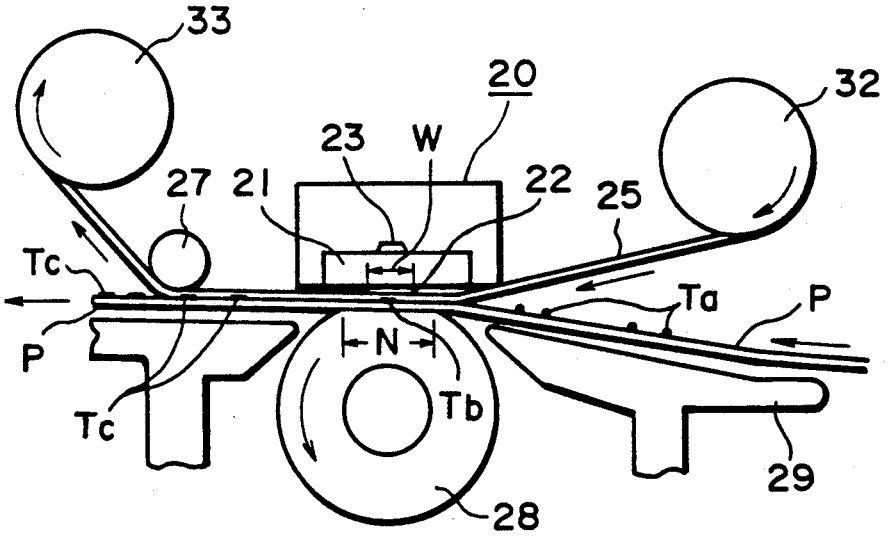

In FIG. 7, a reference symbol N denotes a contact portion between the heating element 20 and the pressurizing roller 28, W denotes the width of a wire-like heat generating layer, Ta denotes a non-fixed toner image, Tb denotes a melting toner image, and Tc denotes a cooled toner image. Designated by reference numerals 32 and 33 are a supply roller and a take-up roller.

Figure 8:
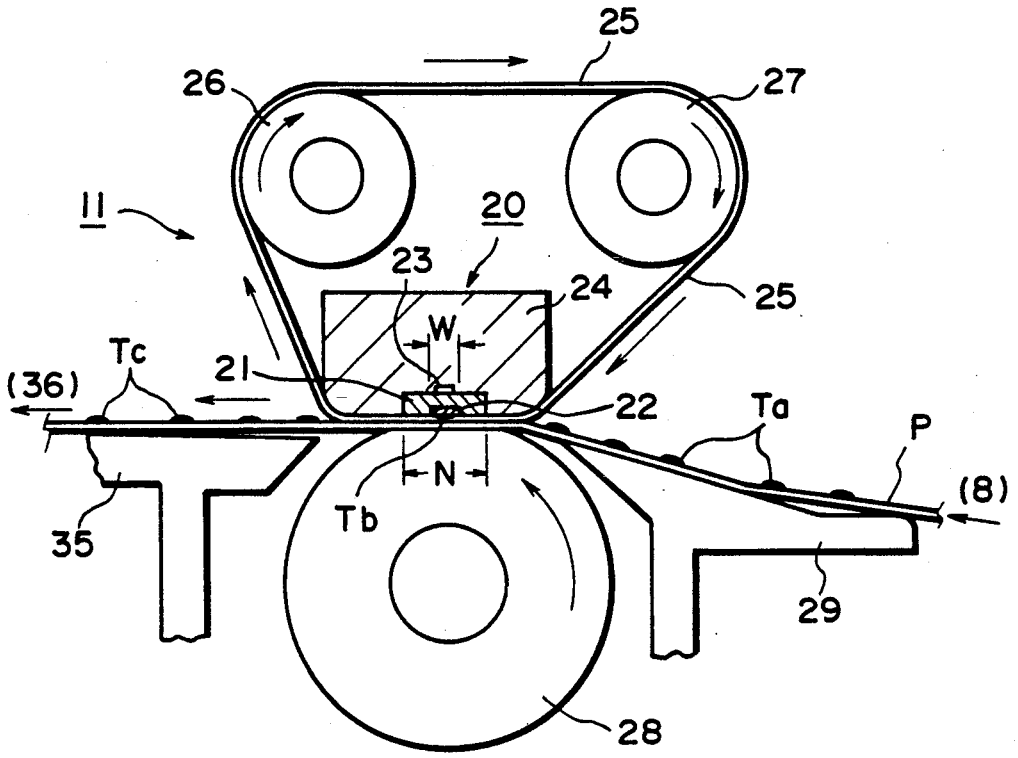
FIG. 8 is a sectional view of an image fixing apparatus according to an embodiment of the present invention.

FIG. 8 is a sectional view of an apparatus according to a further embodiment of the present invention.

An endless fixing film 25 is stretched around a left side driving roller 26, a light side follower roller 27 and a low thermal capacity linear heater 20 fixed at a lower position between the rollers 26 and 27, the rollers 26 and 27 and the heater 20 being extended parallel to each other.

The follower roller 27 functions as a tension roller for applying tension to the endless fixing film 25. When the driving roller 26 rotates in the clockwise direction, the fixing film 25 is rotationally driven without crease, snaking movement and delay, at a peripheral speed which is substantially the same as the transfer sheet P having thereon the unfixed toner image Ta supplied from the image forming station 8.

A pressing roller 28 functioning as a member for urging the sheet has a rubber elastic layer having a good releasing property, made of silicone rubber or the like. It presses the bottom travel of the endless fixing film 25 to the bottom surface of the heater 20, by an unshown urging means, with the total pressure of 4–7 kg. It rotates in the same peripheral direction as the transfer sheet P, that is, in the counterclockwise direction.

Since the endless fixing film 25 is repeatedly used for the heat-fixing the toner image, it is good in the heat resistivity, the releasing property and the durability. Generally, it has a thickness of not more than 100 microns, preferably not more than 50 microns. It is a single layer film made of heat resistive resin such as polyimide, polyetherimide, PES or PFA (copolymer of tetrafluoroethylene and perfluoroalkylvinyl ether), or a compound layer film including a film having a thickness of 20 microns and a releasing coating layer of 10 microns, at least at the image contacting side of the film, including fluorinated resin such as PTFE (tetrafluoroethylene resin) or PFA resin and conductive material added thereto.

A heater supporting member 24 is heat-resistive, and provides the entire mechanical strength of the heater 20. It is made of a highly heat resistive resin such as PPS (polyphenylene sulfide), PAI (polyamide imide), PI (polyimide), PEEK (polyether ether ketone) or liquid crystal polymer, or a compound material including such a resin and ceramic material or glass.

A base plate 21 for the heater is, for example, an alumina base plate having a thickness of 1.0 mm, a width of 9 mm and a length of 240 mm. A heat generating element 22 is in the form of a line or stripe having a low thermal capacity. It has, for example, a width of 1.0 mm and is extended along the length of the base plate 21 substantially at the middle thereof. It is made of, for example, $Ta_2N$ or other electric resistance material which generates heat upon electric energization. A temperature detecting element 23, for example, is a low thermal capacity temperature measuring resistor such as Pt film applied by screen printing or the like along the length substantially at the center of the top surface (opposite from the surface having the heat generating element 22) of the base plate 21.

The alumina base plate 21 has a good thermal conductivity so that it shows a temperature quickly responding to the temperature change of the heat generating element 22. The temperature detecting element 23 detects the temperature of the alumina base plate 21, and feeds it back to the heat generating element, so that the peak temperature upon energization, of the heat generating element 22 is maintained substantially constant.

In this embodiment, the linear or stripe heat generating element 22 is supplied with electric power by the electric connections at the longitudinal ends to generate heat along the entire length of the heat generating element 22. The energization is performed through an energization control circuit so that DC 100 V pulses are applied at the period of 20 msec with the pulse width being changed in accordance with the temperature detected by the temperature detecting element 23 and the energy radiation. The pulse width is controlled with the range of 0.5–5 msec, and the heat generating element 22 is instantaneously heated up to 200°–300° C. each time the pulse is applied. In this embodiment, there is a sensor (not shown) for sensing the leading and trailing edges of the sheet adjacent to the fixing device at its upstream side with respect to the transfer sheet conveyance direction. Using the detection signal by the sensor, the energization period for the heat generating element 22 is limited to the period in which the sheet P is passing through the fixing device 11.

The fixing film 25 is not limited to the endless belt. As shown in FIG. 3, it may be a non-endless film rolled on a supply shaft 30 which is extended to the take-up shaft by way of the heater 20 and the pressing roller 28. The film is traveled from the supply shaft 30 to the take-up shaft 31 at the same speed as the transfer sheet P.

An operation of the apparatus of FIG. 1 embodiment will be described. Upon image formation start signal, the image forming apparatus forms an image and feeds the sheet from the transfer station 8 to the fixing device 11. When the leading edge of the sheet P having the unfixed toner image Ta on its top surface is detected by the sensor (not shown) disposed adjacent to the fixing device, the fixing film 25 starts to rotate or travel. The transfer sheet P is guided along the guide 29, and is introduced into the nip N (fixing nip) between the fixing sheet 25 and the pressing roller 28, by which the toner carrying side of the sheet P is closely contacted to the bottom surface of the fixing film moving at the same speed as the sheet P, and they are passed together through the nip without surface deviation or crease.

Figure 9:
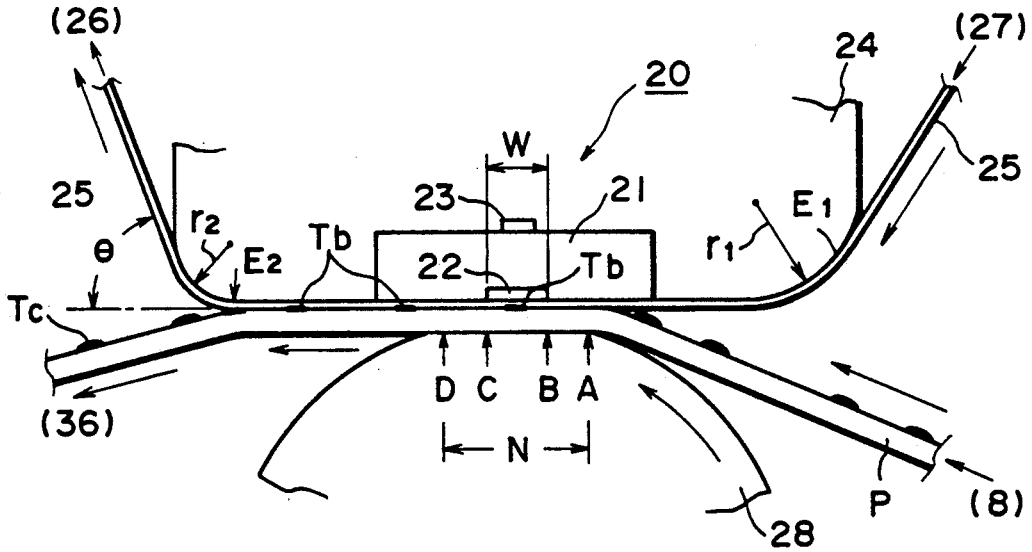
FIG. 9 is an enlarged view of a nip in the image fixing apparatus of FIG. 8.

FIG. 9 is a schematic enlarged cross section of the bottom surface of the heater including the nip between the heater 21 and the pressing roller 28.

The bottom surface which is in sliding contact with the fixing film 25 is rounded at the front end E1 and back end E2 of the supporting member 24. The radii are $r_1$ and $r_2$, respectively. The fixing film 25 advances smoothly to the bottom surface of the heater along the rounded front end E1 from the follower roller 27 and is further advanced in sliding contact with the bottom surface of the heater. Then, it is deflected toward the driving roller 26 upwardly with a large deflection angle $\theta$ along the rounded back end E2.

The heat generating element 22 has a width W which is within the fixing nip N formed between the bottom surface of the heater 20 and the pressing roller 28.

Reference characters A, D, B and C are an upstream end of the width of the fixing nip N with respect to the direction of the travel of the fixing film, a downstream end thereof, an upstream end of the width W of the heat generating element, and a downstream end thereof.

(1) The unfixed toner image Ta on the transfer sheet P introduced into the fixing device 11 enters the fixing nip N at the position A and is started to receive heat from the heater 20 through the fixing film 25.

(2) When it is passing by the heater 22 from the position B to the position C, the temperature of the toner is highest, so that the toner is completely fused (high temperature fusing), and is fuse-bonded on the sheet P surface. In this region where the toner is directly under the heat generating element 22, the toner temperature is so high that the high temperature toner off-set is possible.

(3) During the period in which the toner image passes from the position C to the position D after passing through the portion of the heat generating element 22, the bottom surface temperature of the heater 20 is lower than the temperature thereof between the position B and the position C, so that the temperature of the toner Tb decreases, by which the toner viscosity increases as compared with that in the position between the positions B and C.

(4) When the toner image passes in the region from the position D which is the end of the fixing nip N and the rounded back end E2 of the bottom surface of the heater, the sheet P is conveyed while being adhered to the bottom surface of the fixing film 25 by the adhesive nature of the softened toner Tb.

During the period in which the toner reaches the rounded end E2, the temperature of the toner further decreases, and it becomes outside the high temperature offset region. However, the temperature of the toner is higher than the glass transition point of the toner.

(5) At the rounded end E2 of the heater 20, the fixing film 25 deflects toward the driving roller 26 with the large deflection angle $\theta$ around the rounded back end E2 having the small radius of curvature $r_2$. That is, the fixing film is deflected so that it is quickly away from the sheet P surface. The rigidity of the sheet P overcomes the bonding force of the sheet P to the fixing film 25, by which the sheet P and the fixing film 25 are separated at the rounded back end E2 (separation position).

As described, at the separating position, the temperature of the toner Tb is higher than the glass transition point, and therefore, the bonding force between the sheet P and the fixing film 25 is small at the separation point, and the toner is heated sufficiently up beyond the toner fusing point in the region between the positions B and C and is completely fused. For those reasons, the sheet P is always smoothly separated without hardly any toner offset to the fixing film 25 and without the sheet P sticks to the fixing film 25 and with the resultant jamming.

The toner Tb at the temperature higher than the glass transition point has proper rubber characteristics so that the toner image at the separating point does not follow the surface of the fixing film, and therefore, it has a sufficiently rough surface property. Then, the toner is cooled and solidified without changing the surface property. Therefore, the toner image fixed is not glossy, and has a high quality.

(6) The sheet P separated from the fixing film 25 is guided by the guide 35 and is conveyed to the couple of discharging rollers 36. During the conveyance, the temperature of the toner Tb decreases from the temperature higher than the glass transition point by spontaneous cooling, and becomes lower than the glass transition point, and is solidified into a solidified toner image Tc. The sheet P thus having the fixed toner image is discharged to the tray 12.

As an actual example, a toner mainly made of a thermoplastic resin and having a glass transition point of 50° C. and a fusing point of 130° C. was used. The good results were obtained when the surface temperature of the fixing film at the position A was 110° C.; the temperature was 150° C. in the region between the positions B and C; the temperature was 130° C. at the position D; and the temperature was 100° C. at the position E2 (separating position). Between the positions D and E2, the temperature of the toner Tb is maintained higher than the glass transition point of the toner, more particularly between the glass transition point and the fusing point, so that the toner Tb is in the form of rubber, thus providing proper adhesiveness with the film 25.

The radius of curvature at the sheet separating position, that is, the radius of curvature $r_2$ of the rear rounded end E2 of the bottom surface of the heater is preferably 0.5–10 mm, and further preferably not more than 5 mm. The deflection angle $\theta$ of the film 25 is not less than 5 degrees, preferably, not less than 25 degrees.

In this embodiment, the linear heat generating element 22 of the heater 20 is instantaneously heated upon energization to a sufficiently high temperature in consideration of the toner fusing point (or fixable temperature), and therefore, it is not necessary to keep the heat generating element energized during the stand-by state of the apparatus. Therefore, only little heat is transferred to the pressing roller 28 when the fixing operation is not carried out. During the fixing operation, in the fixing nip N between the heater 20 and the pressing roller 28, the fixing film, the toner image and the sheet P are disposed, and the heating period is short. For those reasons, there exist a steep temperature gradient. Therefore, the pressing roller 28 is not easily heated, and therefore, the temperature thereof is maintained lower than the toner fusing point even when a practical continuous image forming operation is performed. In the apparatus of this embodiment, the toner image made of the heat-fusible toner on the sheet P is first heated and fused by the heater 20 through the fixing film, and particularly, the surface layer of the toner is completely softened and fused. At this time, the heater, the fixing film, the toner image and the sheet are urged by the pressing roller 28, so that the heat is efficiently transferred. By this, the toner image can be efficiently heated and fused with minimum heating of the sheet P itself. In addition, the energization period is limited. For those reasons, the energy consumption can be saved. The size of the heater may be small, and therefore, the thermal capacity may be small. Therefore, it is not necessary to pre-energize the heater during the stand-by period. The power consumption during the non-fixing-operation can be reduced, and in addition the temperature rise within the apparatus can be prevented.

In this embodiment, the toner temperature at the separating point is higher than the glass transition point. However, it is further preferable that the temperature is higher than the fusing point ring and ball softening point. This is effective to prevent the toner offset and to suppress the gloss, which is confirmed by the inventors' experiments.

It is preferable that the toner temperature at the separating point is lower than the fusing point to increase the coagulation force.

When the toner has a plurality of glass transition points, the glass transition point when it is said that the toner temperature at the separating point is higher than the glass fusing point, means the maximum glass fusing point, in order to prevent the existence of the portion which has lost the rubber property.

Figure 10:
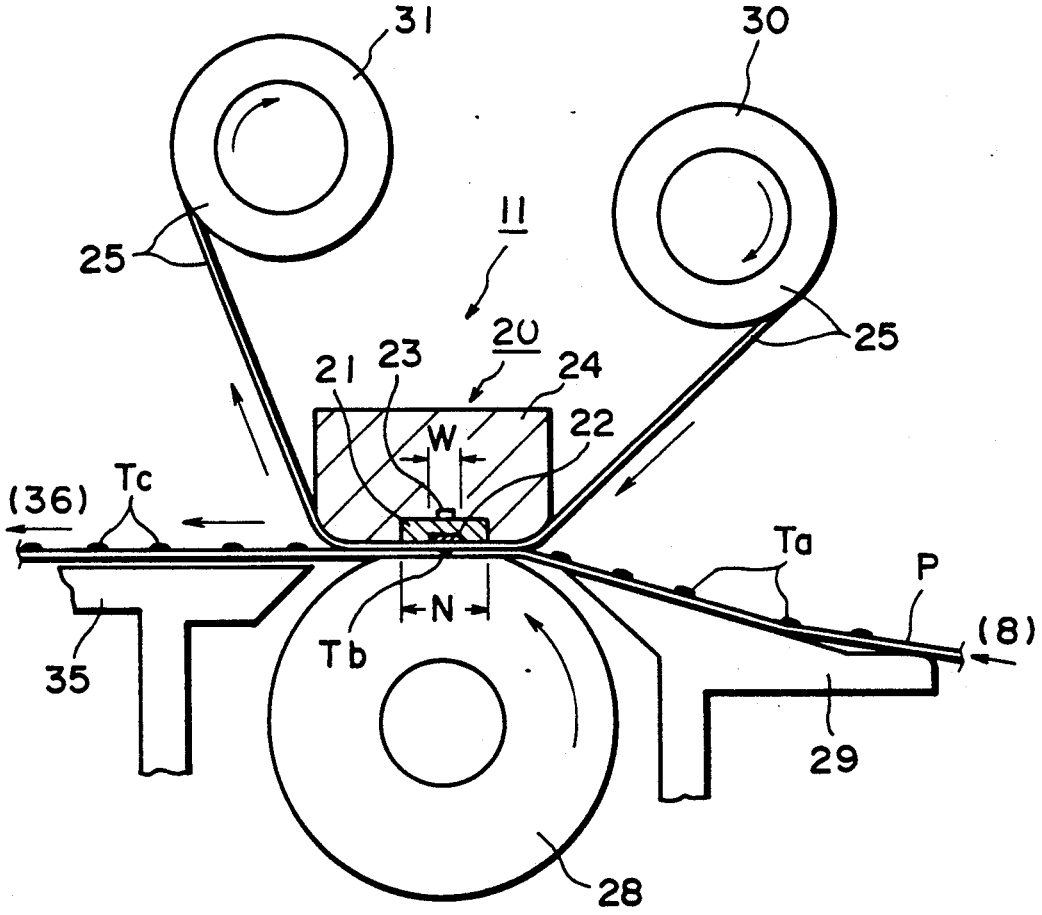
FIG. 10 is a sectional view of an image fixing apparatus according to another embodiment of the present invention.

FIG. 10 shows a further embodiment using a non-endless film.

Referring to FIG. 1, another embodiment of the present invention will be described In this embodiment, the rounded rear end E2 of the bottom surface of the heater 20 is projected downwardly toward the pressing roller 28.

By doing so, after the sheet P passes through the fixing nip N (between the positions A and D), sheet P is lightly urged to the surface of the pressing roller 28 by the downward projected portion E2 of the bottom surface of the heater until the fixing film 25 is separated from the sheet.

(1) Therefore, the close contact between the fixing film 25 surface with the sheet P and the toner image Tb is assured from the rear end position D of the fixing nip N to the rounded rear end E2 of the heater. In the first embodiment (FIG. 2), when the amount of the toner on the sheet P is significantly small, the bonding force by the softened toner Tb between the sheet P and the fixing film 25 is significantly small, so that the sheet P is separated from the fixing film 25 by the gravity while it moves from the position D to the separating position E, with the result of possible unstable sheet conveyance. With the structure of this embodiment, even if the amount of the toner is significantly small, the sheet conveyance to the separating position E is stabilized, so that the sheet P is first separated from the fixing film 25 surface at the separating position E, and therefore, the sheet conveyance is stabilized.

In this embodiment, the sheet is stably conveyed without significantly relying on the bonding force between the toner and the film. Therefore, the temperature of the heater can be increased so that the fixing property is improved beyond the first embodiment. In this embodiment, the surface temperature of the fixing film in the region directly below the heat generating element, that is, the region between the positions B and C is 180° C. which is higher than in the first embodiment (150° C.). By doing so, the surface temperature of the fixing film at the position D is 160° C. which is higher than the toner fusing point (130° C.). Between the position D and the separating position E, the toner image Tb and the sheet P are conveyed between the pressing roller 28 and the supporting member 24 of the heater 20 while stably contacted to the fixing film 25 surface, and therefore, the heat of the toner is transferred to the pressing roller 28 or to the supporting member 24. When it reaches the separating position E, the temperature of the toner is 90° C. which is between the toner fusing point (130° C.) and the glass transition point of the toner (50° C.) Therefore, the sheet P is smoothly separated from the surface of the fixing film 25 without the toner offset or adherence to the fixing film 25. This permits to increase the temperature of the heater to stabilize the fixing performance.

When the toner is made of such material as to provides sufficient coagulation even under the temperature higher than its fusing point, it is possible that the temperature of the toner at the separating point is slightly higher than the fusing point.

Figure 12:
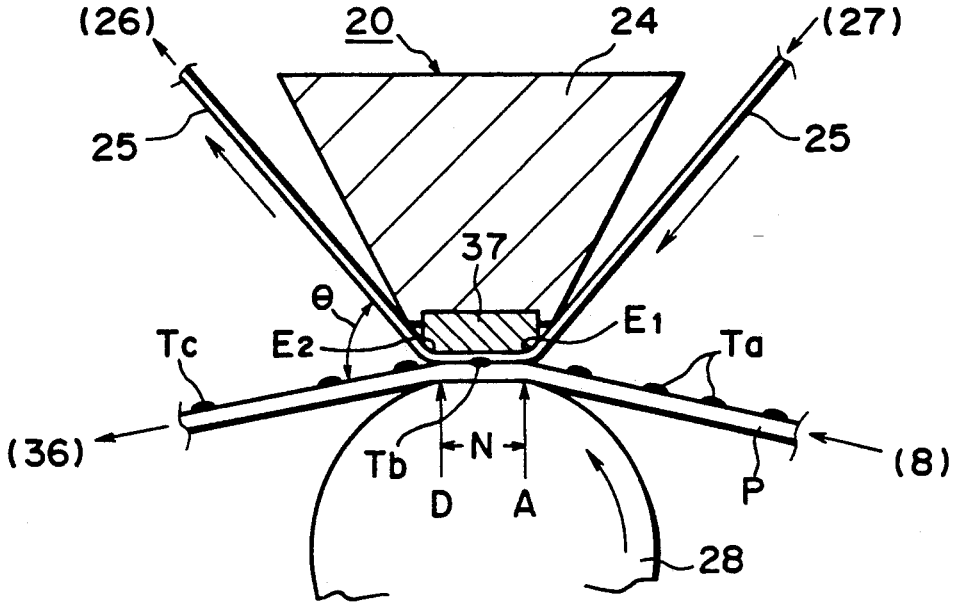

Referring to FIG. 12, a further embodiment of the present invention will be described. In this embodiment, the heat generating element of the heater 20 is made of a ceramic base plate 37 having such a PTC property that the electric resistance thereof steeply increases at a temperature higher than 180° C. Therefore, the temperature is self-controlled at 180° C. The surface temperature of the fixing film between the positions A and D, that is, in the region of the fixing nip N, is approximately 170° C. The glass transition point of the used toner is 60° C., and the fusing point is 150° C. The toner has sufficient coagulation force even if it is beyond the fusing point. The rear end D of the fixing nip N is the separating point, and the rear end E2 of the ceramic base plate 37 is rounded with a radius of curvature of 2 mm. The deflection angle $\theta$ of the fixing film 25 at the separating point D is 50 degrees.

The toner Tb heated beyond the fusing point in the fixing nip N is separated from the fixing film 25 surface at the separating position D by the deflection.

The temperature of the toner at the time of the separation is not less than the fusing point. Still, however, the coagulation of the toner itself is sufficiently large, so that the toner Tb is separated from the fixing film 25 surface together with the sheet P, and therefore, the amount of the toner remaining on the fixing film 25 surface is small.

Figure 13:
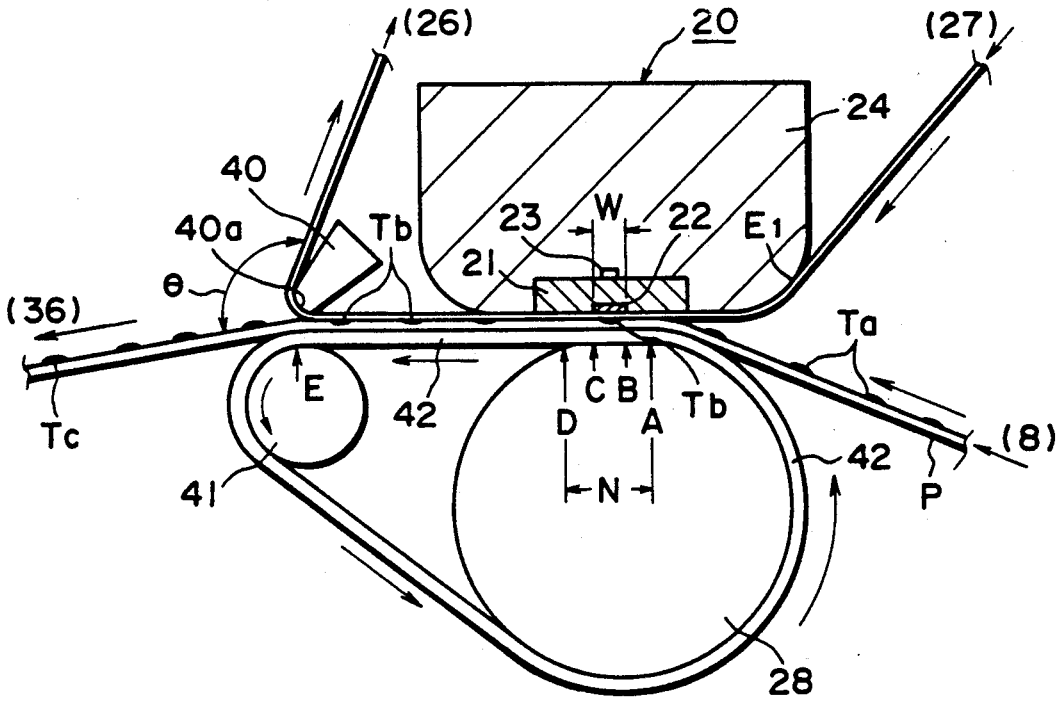

Referring to FIG. 13, a further embodiment will be described. In this embodiment, the structure of the heater 20 is same as in the first embodiment in this embodiment, a fixing film guiding member 40 and a small roller 41 are disposed downstream of the heater 20 and the pressing roller 28, respectively, with respect to the sheet conveyance direction. The fixing film 25 is deflected upwardly from the bottom surface of the heater 20 by way of the leading edge of the guiding member 40. Between the pressing roller 28 and the small roller 40, a conveying belt 42 made of silicone rubber with base cloth having a thickness of 500 microns is stretched. The small roller 41 is effective to rotationally drive the belt 42. The guiding member 40 functions as a separating member. The radius of curvature of the bottom edge 40*a* around which the fixing film 25 is deflected is 1 mm, and the deflection angle $\theta$ is 120 degrees.

The fixing nip N is defined by the heater 20 and the pressing roller 28 sandwiching the fixing film 25 and the conveying belt 42. The toner image Ta on the sheet P introduced is heated by the fixing nip N, that is, between the positions A and D. Thereafter, the sheet P is conveyed while being supported by the conveying belt 42 so that it is urged to and closely contacted to the bottom surface of the fixing film 25 until it reaches the bottom end of the guiding member 40 at the separating position E. At the separating position E, it is deflected and separated from the film 25. The toner Ta used in this embodiment has the glass transition point of −10° C., the fusing point of 70° C. It is made mainly of wax resin. The viscosity thereof steeply decreases when the temperature is higher than 70° C., that is, it has a so-called sharp melting property. The surface temperature of the fixing film directly under the heat generating element 22, that is, between the positions B and C, is 100° C. which is far beyond the toner fusing point, so that the toner Ta is completely fused and is strongly bonded on the surface of the sheet P.

The surface temperature of the fixing film at the position D is 90° C., and the viscosity of the toner is still significantly low. During the period in which the toner Tb is conveyed to the separating position E, it is cooled by radiation down to 55° C. which is between the fusing point 70° C. and the glass transition point −10° C., so that the coagulation force of the toner is sufficiently high. Therefore, it is separated by deflection from the film 25 in good order without the toner remaining on the fixing film 25 at the separating position E. According to this embodiment, even if the toner has the sharp melting property, the high temperature off-set of the toner does not result, because the sheet is conveyed assuredly to the separating position E with the contact between the toner and the film maintained until the toner temperature becomes lower than the fusing point.

Figure 14:
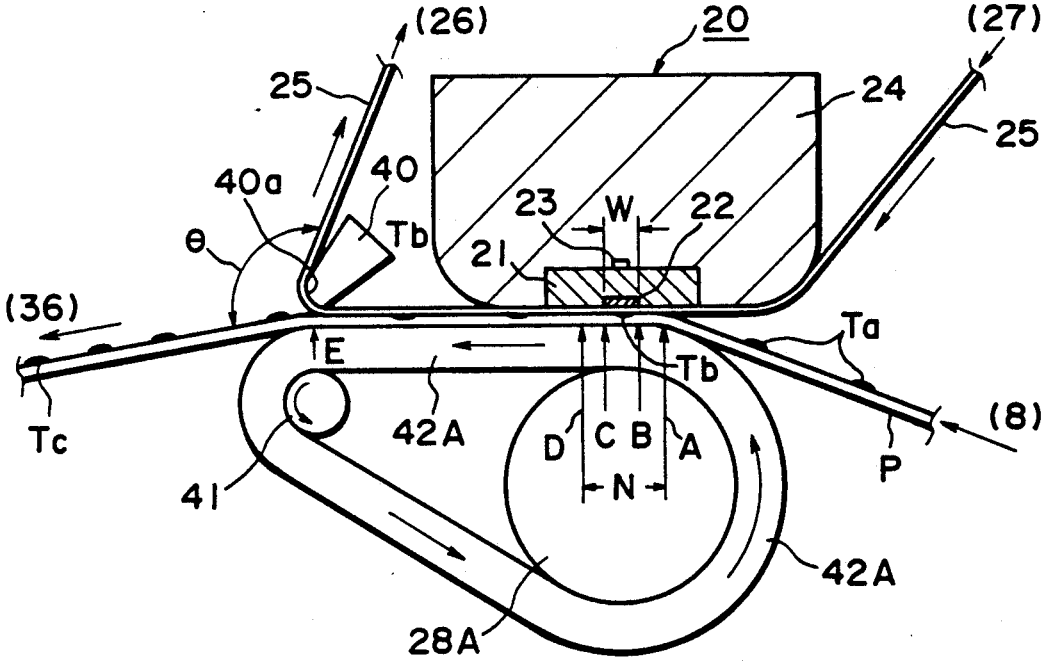

Referring to FIG. 14, a further embodiment will be described In this embodiment, the conveying belt is a silicone rubber belt 42*a* having a thickness of 3 mm, and in place of the pressing roller (28) a core metal 28A is used.

Since the belt 42A has a high rigidity so that it provides a strong urging force for urging the toner Tb to the bottom surface of the fixing film 25. Therefore, there is no liability that the toner having passed through the fixing nip N is separated from the film surface before reaching the separating point E.

The base plate 21 of the heater 20 may be, in addition to the alumina, a heat resistive glass, or heat resistive resin such as PI or PPS. The material of the heat generating element 22 may be, in addition to $Ta_2N$, nichrome $RuO_2$, Ag-Pd or another resistor. The temperature detecting element 23 may be made of a bead thermister having a low thermal capacity in place of the temperature detecting resistor such as Pt film. The bottom surface of the heater with which the fixing film 25 is in sliding contact is preferably provided with a protection layer such as a heat-resistive glass layer for protection from the sliding movement. The heat generating element 22 may be disposed on the top surface of the base plate 21, opposite from the film contacting side of the base plate 21, whereas the temperature detecting element 23 may be disposed at the bottom side of the base plate 21 (opposite from the fixing film contacting side). Further, both of the heat generating element 22 and the temperature detecting element 23 are disposed on the bottom side of the base plate 21. The energization of the heat generating element 22 may be in unusual AC voltage form, in place of the pulse energization.

When the fixing film 25 is a non-endless one, as shown in FIG. 10, a replaceable rolled film can be employed, wherein when almost all of the fixing film is taken-up on the take-up reel, a new roll of film is mounted (a wind-up and exchange type). In this type, the thickness of the fixing film can be reduced substantially irrespective of the durability of the fixing film, so that the power consumption can be reduced. For example, the fixing film in this case may be made of a less expensive material such as PET (polyester) film which is treated for heat-durability having a thickness of 12.5 microns or lower, for example.

Alternatively, in view of the fact that the toner off-set to the fixing film surface is not practically produced, the used fixing film taken-up on the take-up shaft can be rewound on the feeding shaft, or the take-up shaft and the feeding shaft are interchanged to use the fixing film repeatedly, if the thermal deformation or thermal deterioration of the fixing film is not significant (a rewinding and repeatedly using type).

In this type, the fixing film is preferably made of a material exhibiting high heat-resistivity and mechanical strength, such as polyimide resin film having a thickness of 25 microns which is coated with a parting layer made of fluorine resin or the like having a good parting property to constitute a multi-layer film. A press-contact releasing mechanism is preferably provided to automatically release the press-contact between the heater and the pressing roller during the rewinding operation.

Where the fixing film is used repeatedly as in the rewinding type and an endless belt type, a felt pad may be provided to clean the film surface and to apply a slight amount of parting agent such as silicone oil by impregnating the pad with the oil, by which the surface of the film is maintained clean and maintained in good parting property. Where the fixing film is treated with insulating fluorine resin, electric charge is easily produced on the film, the electric charge disturbing the toner image. In that case, the fixing film may be rubbed with a discharging brush which is electrically grounded to discharge the film. On the contrary, the film may be electrically charged by applying a bias voltage to such a brush without grounding as long as the toner image is not disturbed. It is a possible measure against the image disturbance due to the electric charge to add carbon black or the like in the fixing film. The same means is applicable against the electric charge of the back-up roller. As a further alternative, anti-electrification agent may be applied or added.

In any of the endless belt type, the take-up and exchange type and the repeatedly using type, it may be in the form of a cartridge detachably mountable to a predetermined position of the fixing device 11 to facilitate the exchange or the like of the fixing film.

The fixing device of this invention is not limited to an image transfer type electrophotographic copying apparatus, but is applicable to a type wherein a toner image is directly formed and carried on an electrofax sheet or an electrostatic recording sheet or the like, wherein the image is formed and recorded magnetically, or wherein an image is formed with a heat fusible toner on a recording medium by another image forming process and means. An example of such apparatus are heat-fixing type copying machine, laser beam printer, facsimile machine, microfilm reader-printer, display device and recording device. The present invention is applicable to them.

Referring to FIG. 15, a further embodiment of the present invention will be described. In this embodiment, the heater 20 comprises a heater fixing member 24 which is a square elongated member extending in the lateral direction of the fixing film. It is made of a high rigidity, a high heat-resistivity and a low thermal conductivity material such as PPS, polyimide or Bakelite. In another structure of the heater supporting member, the heat resistive and low thermal conductivity material is used in the region contacting to a heater base plate 21 which will be described in detail hereinafter, and the other portion is made of another material.

The heater base plate 21 is an elongated member extending along the bottom surface of the fixing member 24 in the longitudinal groove 24*f*. The heater base plate 21 is made of ceramic material having a good thermal conductivity such as alumina having a length of 40 mm, a width of 10 mm and a thickness of 1.0 mm. On the bottom surface of the base plate 21, a heat generating resistor 22 is formed in a line or stripe along the length thereof at substantially the center. The heat generating resistor 22 is made of nichrome, tungsten, silver-palladium (Ag/Pd), ruthenium oxide ($RuO_2$), $Ta_2N$ or a material mainly composed of such a material (heat generating resistor generating heat upon electric energization). It is applied on the base plate by screen printing or the like with the width of 1.0 mm and the thickness of 20 microns. A surface heat generating element such as ceramic heater or the like may be used.

A low thermal capacity temperature detecting element 23 in the form of a temperature detecting resistor (Pt film), a thermister or the like, is applied by screen printing or implanted on the surface of the base plate 21 which is opposite from the heat generating resistor 22 side of the base plate 21, substantially at the center thereof. It is preferable that the temperature detecting element is within the fixing nip N where the pressing roller 28 is pressed to the heater 20 through a fixing film 24. The surface of the heater base plate 21 including the temperature detecting element 23 is coated with a protection layer 21*a* the protection layer is made of anti-wearing material such as glass or ceramic material, and it has a small thickness, 10 microns for example.

A cavity 24*g* is formed at least between a rear portion corresponding to the fixing nip N in the surface side of the heater and the heater fixing member. The cavity 24*g* extends along the length of the heater base 21 at least in the region of the maximum size of the transfer sheet usable. The opposite longitudinal ends are closed to shut the convection thermal transfer with the outside thereof by connective heat transfer. The width of the cavity 24*g* is larger than the width of the heat generating resistor, and further preferably, it is larger than the width of the fixing nip N.

When the electric energy is supplied between the power supply electrodes at the longitudinal opposite ends of the heater 22, the entire length thereof generates heat which heats the base 21 having the good thermal conductivity. The surface temperature of the base 21 is detected by the temperature detecting element 23, and the temperature is fed back to an unshown energization controlling circuit, by which the energization to the heat generating element 22 is controlled to maintain a predetermined constant temperature of the fixing nip.

Since the cavity 24*g* is provided between the rear side of the heater 21 corresponding to the fixing nip N and the heater 21 supporting member 24, the heat of the heater 21 is prevented from wastefully transferring to the supporting member 24 from the rear side of the heater by the heat insulating function of the air in the cavity 24*g*. Therefore, the ratio of the heat quantity from the surface of the heater to the fixing film 25 through the fixing nip N to the total heat of the heater 21, increases. Therefore, the thermal efficiency is increased, by which the energy consumption required for fixing the image is reduced. Using the heater having such a cavity 24*g* and a heater without using the cavity and the entirety of the backside of the heater 21 being contacted to the supporting member 24, the fixing operations were performed under the same conditions. The electric power required for fixing the toner on the transfer sheet P immediately after the fixable state is reached from the room temperature condition, was only 60% of the electric power required by the heater without the cavity 24*g*. Therefore, 40% save of the energy was achieved.

This is because the thermal conductivity of the air in the cavity 24*g* is only 0.03 W/m.deg which is far smaller than 0.2 W/m.deg which is the thermal conductivity of the polyimide resin constituting the heater fixing member 24, and therefore, the ratio of the heat transferred to the surface of the heater 21, that is, to the fixing film to the heat generated by the heat generating resistor is increased.

In this embodiment (FIG. 15), the temperature detecting element 24 is disposed within the fixing nip N on the surface side of the heater 21. This is firstly because it is preferable in order to increase the accuracy of the temperature control of the heater 20 to detect directly and real time the temperature of the fixing nip N, that is, the surface side temperature of the heater base 21, and secondary because the heater of this embodiment is provided with the cavity 24*g* at the heater surface side to provide the air insulation, and therefore, the heat radiation speed at the backside of the heater is lower than that at the heater front surface side providing the fixing nip N, with the result of the possibility of the temperature difference between the front side temperature and the backside temperature of the heater.

FIGS. 16A, 16B and 16C show examples of the dispositions of the temperature detecting elements 23. Reference characters C and W indicate the center line of the passage of the sheet, and the maximum sheet passage width, respectively. The transfer sheets P having various sizes within the maximum passage width W can be passed to be subjected to the fixing operation with the center lines thereof aligned with the center line C.

In FIG. 16A, the temperature detecting element 23 is disposed on the surface of the heater base 21 substantially on the center, that is, on the center line C. In this example, the temperature at the sheet passing portion can be detected irrespective of the size (width) of the transfer sheet P.

In the example of FIG. 16B, the temperature detecting element 23 extends along the entire length of the heater base 21 surface in the sheet passage region W, by which the average temperature in the region can be detected. In addition, there is no step despite the provision of the temperature detecting element.

In FIG. 16C, first and second temperature detecting elements 23 and 23*a* are disposed on the front surface side and the back surface side of the heater base 21 on the center line C. It is possible that the first temperature detecting element 23 on the front surface of the heater base 21 is used to control the temperature of the heater 20 by energization control to the heat generating element 22, and the second temperature detecting element 23*a* on the back side of the heater base 21 is used to prevent the overheating of the heater. The second temperature detecting element 23*a* is mounted on the heat generating element 22 through an insulating layer 21*g*.

Figure 17:
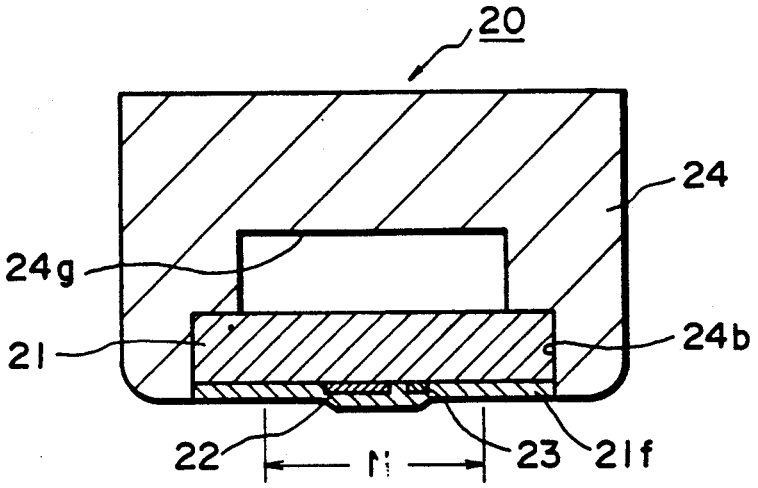
FIGS. 17 and 18 are sectional views of another examples of the heater.

As shown in FIG. 17, the heat generating element 22 of the heater base 21 may be disposed on the surface of the base plate 21. More particularly, the heat generating member 22 (heat generating resistor) and the temperature detecting element 23 are disposed within the range of the fixing nip N on the surface of the base 21. With this arrangement, the heat generating position is close to the fixing film and the toner, and therefore, the thermal efficiency is good. In this example, the material of the heat generating resistor 22 may be made of a material such as barium titanate having PTC property In this case, when the temperature of the resistor increases by the electric energization nearly to the Curie temperature, the resistance thereof steeply increases with the result of reduced amount of heat generation, and therefore, the temperature is self-controlled at the level inherent to the resistor. Therefore, the necessity for the temperature detecting element 23 is eliminated.

Figure 18:
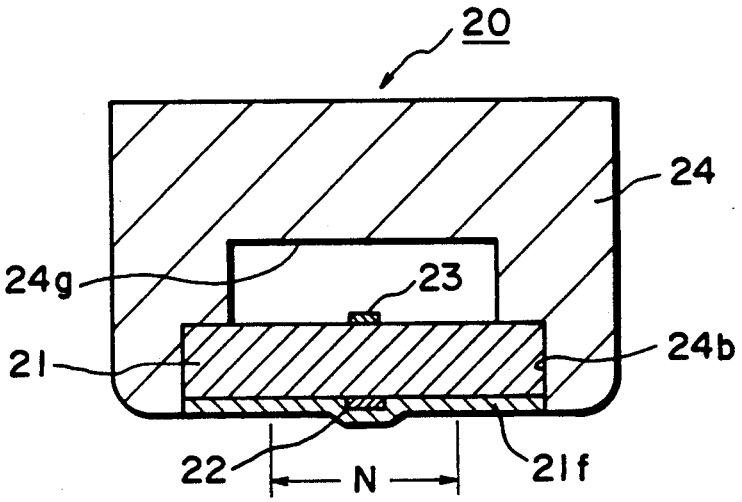
Figure 19:
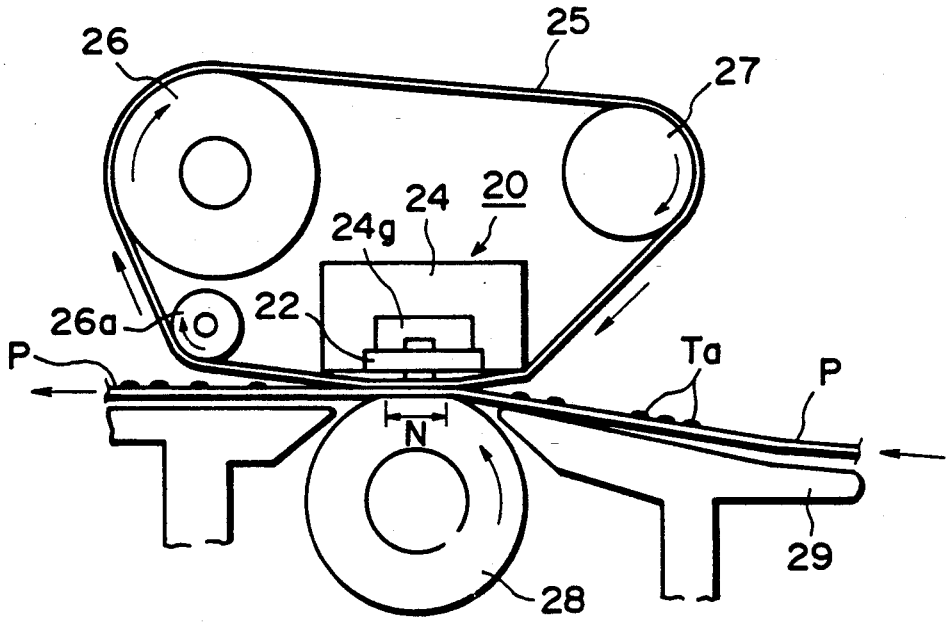
FIG. 19 is a sectional view of an fixing apparatus according to a further embodiment of the present invention.

As shown in FIG. 18, the heat generating element 22 may be mounted on the front surface of the base plate 21, and the temperature detecting element 23 may be mounted on the backside of the base plate 21 (opposite to the embodiment of FIG. 15). With this structure, the detected temperature can be different from the surface temperature of the heater base 21, and therefore, the relationship between the surface temperature of the heater base and the temperature of the back surface is determined beforehand, and the front surface temperature is predicted from the detected back surface temperature.

Where the cavity is provided between the heater base and the heater fixing member, the recording material (transfer material sheet) P may be separated from the fixing film 25 surface immediately after the heating step in the fixing nip N, as shown in FIG. 19. Similarly to the foregoing embodiments, the toner temperature at the separating position is higher than the glass transition point.

As will be understood from the foregoing, in the embodiments of the present invention, the low thermal capacity heater fixed is instantaneously raised in the temperature immediately after the electric energization.

The thermal capacity of the heater will be described.

Figure 20:
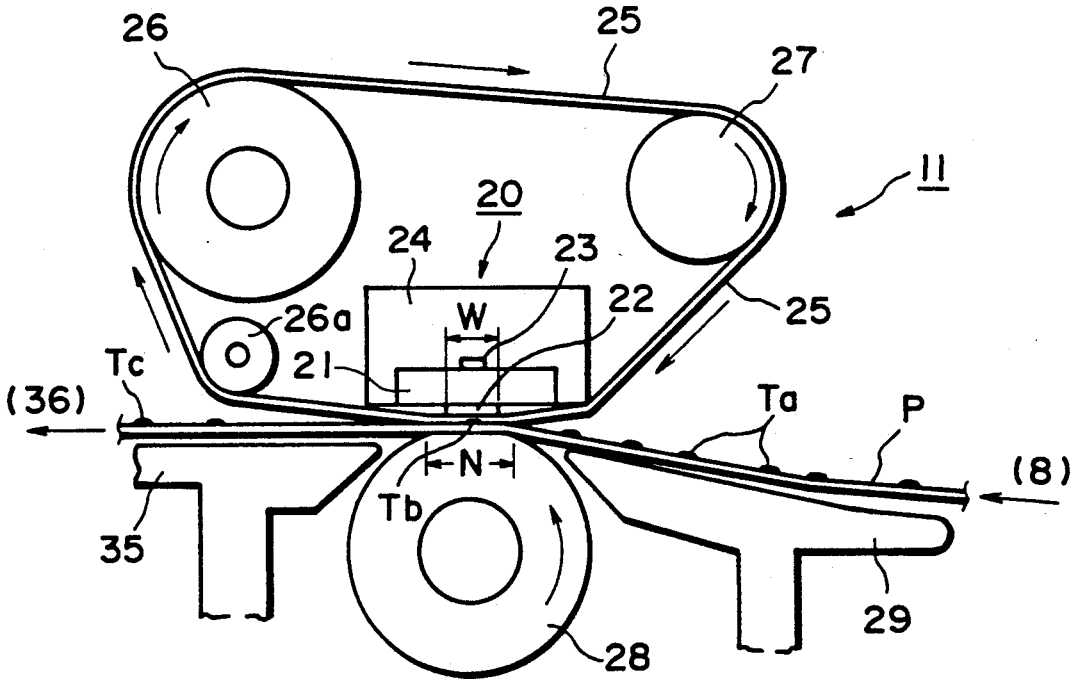
FIG. 20 is a sectional view of an image fixing apparatus according to a further embodiment of the present invention.

Referring to FIG. 20, the description will first be made as to a further embodiment. In this embodiment, the cavity 24*g* of FIG. 19 embodiments is not provided, and the embodiment of FIG. 20 is similar to the embodiment of FIG. 13 in the other respects, and therefore, the detailed description is omitted for simplicity. Reference characters Ta and Tb designates an unfixed toner and a high temperature fused toner, respectively. The temperature of the toner at the separating point is higher than the glass transition point.

While the sheet P separated from the fixing film 25 is being advanced to the couple of discharging rollers 36 along the guide 35, the temperature of the toner Tb having a temperature higher than the glass transition point is cooled spontaneously down to below the glass transition point, and therefore, it is solidified, and therefore, the sheet P on which the image has been fixed is discharged on the tray 12.

Figure 21A:
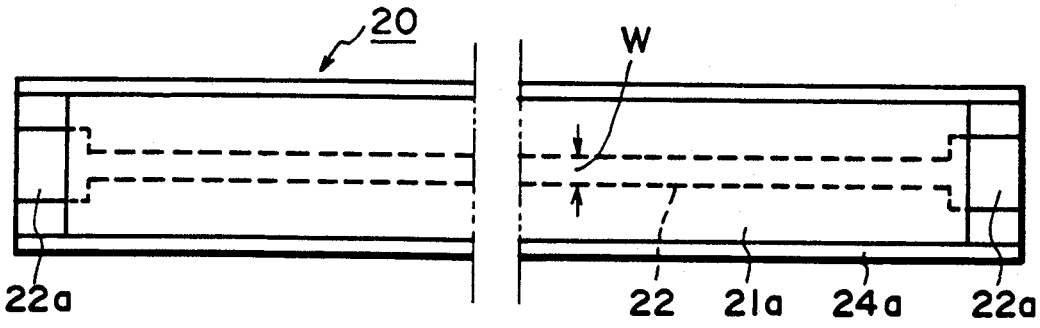
FIGS. 21A and 21B are a top plan view of the heater seen from a sliding surface side at an enlarged sectional view thereof.
Figure 21B:
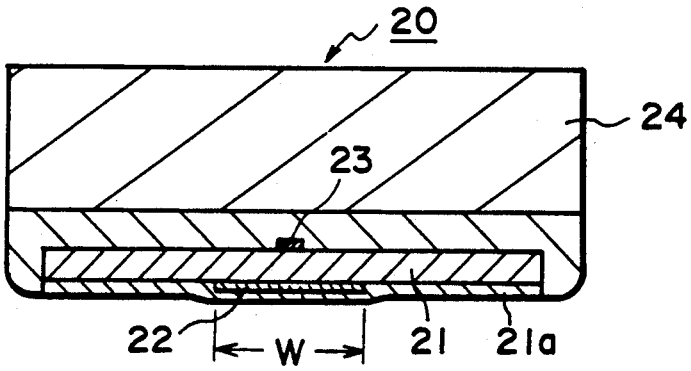

FIGS. 21A and 21B are a top plan view and an enlarged sectional view of the side of the heater 20 which is contactable with the fixing film. The heater has an alumina base plate 21 having a thickness of 0.64 mm, a width of 0.5 mm and a length of 250 mm and a heat generating resistor 22 applied thereon by screen sprinting. The heat generating resistor 22 has a width of 3 mm and a thickness of 20 microns. The heat generating resistor 22 is coated with a protection layer 21*a* having a thickness of 10 microns and made of a heat resistive glass. On the back side of the base plate 21, a temperature detecting element 23 such as a thermister is mounted. The base plate 21 having the heat generating element 22, the protection layer 21*a* and the temperature detecting element 23 is securedly fixed on a rigid supporting member (stay) 24 through an opposite ends of the heat generating element 22 is provided with power supply electrodes 22*a* and 22*a*.

The heater base plate 21 is made of alumina having a thermal conductivity of 25 J/m.S.K. Since it is a good thermal conductor, the temperature of the heat generating element is detected by the thermister 23 with quick response. By controlling the energy supply using the thermister 23, the temperature of the heat generating element 22 can be maintained at the fixable temperature during the fixing process. When a heat-fixing toner available from Canon Kabushiki Kaisha, Japan was used, the temperature of the heat generating element was maintained approximately at 180° C. on the average by the power supply of 150 W on the average, and the toner image was heat-fixed in good order.

The thermal capacity of the heat generating element 22 of this embodiment per unit length (1 mm) is $0.18\times10^{-3}$ J/Km (3 mm$\times$0.02 mm$\times$1 mm$\times3.0\times10^{-3}$ J/m$^3$.K) which is very small, and therefore, the temperature quickly increases upon energization by 300 W. The temperature reaches sufficiently fixable temperature within 5 sec which is the time required from the image formation state to the reaching of the transfer sheet P to the fixing device 11, when the heater is started to be preheated upon the image formation start. Thus, according to this embodiment, the fixing device does not required the waiting period with low power consumption.

In the conventional heating roller type fixing apparatus, the waiting period is longer even if the thermal capacity of the heat generating element is decreased, for the following reasons:

(1) Between the heat generating element and the heating roller, there is an air layer, and therefore, the heating roller is heated by the heat radiation from the heater, and therefore, the temperature of the heat generating element has to be increased far above the toner fusing point: and (2) The thermal capacity of the heating roller to be heated is large, so that the time is required for the heating.

In this embodiment, the heat is transferred from the heat generating element to the toner without the air layer and only through the protection layer 21*a* having a thickness of 10 microns and the fixing film 25 having the thickness of 40 microns, and therefore:

(a) The temperature of the heat generating element may be close to the toner fusing point: and (b) The portion to be heated is only the protection layer 21*a* and the fixing film 25 in the nip which have very small thermal capacities.

Because of the features (a) and (b), the thermal capacity of the heat generating element of this embodiment may be made very small, and therefore, the quick start and the low power consumption are accomplished.

Figure 22:
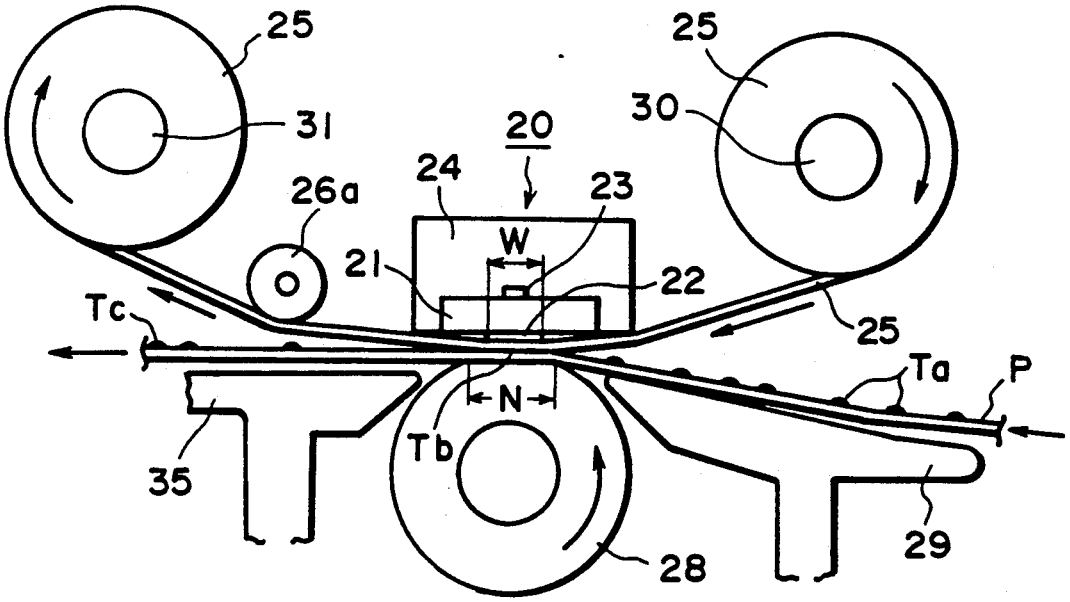
FIG. 22 is a sectional view of an image fixing apparatus according to a further embodiment of the present invention.

Also, in this embodiment, a non-endless film is used which is rewound after use and is repeatedly used, as shown in FIG. 22.

The inventor's experiments have revealed that for the accomplishment of the quick start and the low energy consumption, the thermal capacity per unit longitudinal length of the heat generating element is preferably not more than $2.05\times10^{-3}$ J/k.mm.

Figure 23A:
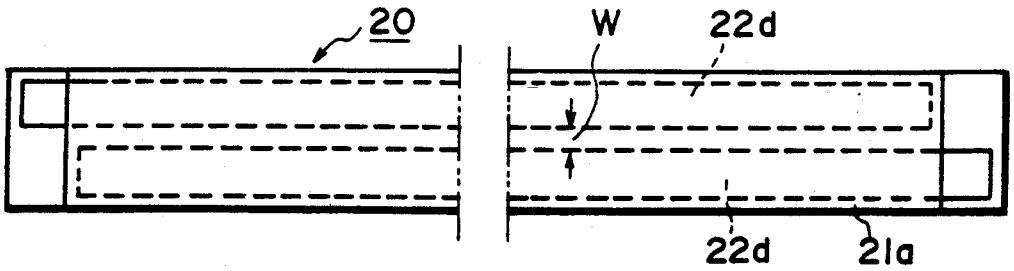
FIGS. 23A and 23B are a top plan view of a heater seen from a sliding surface side and an enlarged sectional view thereof in another example.
Figure 23B:
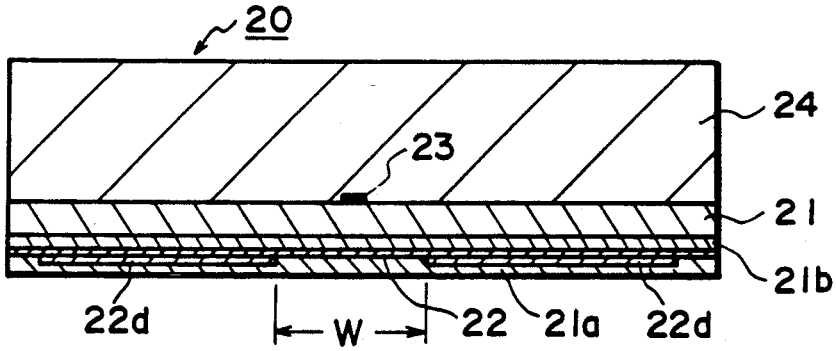

In the foregoing embodiment, the base plate 21 is made of alumina having the good thermal conductivity in order to correctly detect the temperature of the heat generating element 22 on the base plate 21 by the temperature detecting element 23 mounted on the back side of the base plate 21. However, through the base plate 21 having the good thermal conductivity, a part of the heat generated by the heat generating element 22 is released, and therefore, the advantages of the use of the low thermal capacity heat generating element 22 is more or less deteriorated Referring to FIGS. 23A and 23B, a further embodiment of the present invention will be described FIGS. 23A and 23B are top plan view and an enlarged sectional view of a fixing film sliding side of a heater 20. In this embodiment, in order to minimize the release of the heat generated by the heat generating element 22 through the base plate 21, thus increasing the temperature increasing speed of the heat generating element 22, the heat generating element (heat generating resistance layer) is mounted to the base plate (alumina base plate) 21 through an insulating layer 21*b* having a thickness of 500 microns. Designated by reference numerals 22*d* and 22*d* are electrodes made of gold extended on the surface of the heat generating element 22 along the length thereof with a space W therebetween. With the increase of the thickness of the insulating layer 21*b*, and with the decrease of the thermal conductivity thereof, the power consumption is decreased, and the temperature increasing speed is increased. However, the temperature detecting accuracy of the heat generating element by the temperature detecting element 23 is deteriorated. Therefore, the thickness and the material thereof are to be selected in consideration of the property of the toner used (for example, the temperature range from the high temperature off-set temperature and the low temperature off-set temperature).

For example, the heat-fixing toner available from Canon Kabushiki Kaisha, Japan has a wide range between the high temperature off-set temperature and the low temperature off-set temperature, and therefore, the fixing operation is possible without problem even if the base plate 24*a* is made only of glass having a thickness of 1 mm as in the heater 20 shown in FIGS. 8A and 8B. In this case, the fixable temperature was reached only in approximately 3 sec when the power supply is not more than 200 W.

In the example of FIGS. 25A and 25B, the heater 20 includes the base plate 24*a* made of PI resin (polyimide) which is a thermal insulator and a nichrome wire having a diameter of 0.1 mm is fixed on the insulative base plate 21. The thermal capacity per unit length of the heat generating element is $8.2\times10^{-5}$ J/Kmm (0.1 mm$\times$0.1 mm$\times2\times4.1\times10^{-3}$ J/Km). With this heater 20, the quick start is possible with low energy consumption. The temperature detecting element 23 is planted within the thickness of the base plate 24*a*. Designated by a reference 22*e* is a conductor in the form of a spring to accommodate the thermal expansion and contraction of the nichrome wire 22. The diameter of the nichrome wire 22 is larger adjacent the end portions which are not used for the image fixing to reduce the amount of the heat generation.

According to the inventor's experiments, when the resistor wire having a diameter of 0.5 mm that is, the heat generating element having the thermal capacity per unit length is approximately $2.0\times10^{-3}$ J/Kmm (0.5 m$\times$0.5 m$\times2\times4.1\times10^{-3}$ J/Kmm$^3$) was used, the fixable temperature can be reached in approximately 7 sec when it is energized by 300 W power, and therefore the quick start is possible.

The description has been made as to the thermal capacity of the heat generating element 22, the thermal capacity of the heater will be described in terms of the quick start and the reduction of the energy consumption. Here, the heater means the portion which is integrally formed with the heat generating element and is increased in the temperature to a level substantially equal to that of the heat generating element upon energization. The heater contains the heat generating element and the portion of the heat generating element side from the insulating layer. The heat insulating layer is effective to transfer the heat of the heater, and is defined as a layer having a thickness of not less than 100 microns made of a material having a thermal conductivity of not more than 5 J/m.S.K.

As to the structure of the fixing apparatus in this description, the one shown in FIG. 20 is taken. The description will then be made as to the heater 20. The heater 20 has the structure shown in FIG. 15. The heater 20 includes an alumina base plate 21 having a thickness of 1.0 mm, a width of 16.0 mm and a length of 250 mm and a heat generating resistance element made of silver-palladium (heat generating element 22) applied on the base plate 21 by screen printing in a width of 2 mm and a thickness of 20 microns. On the heat generating element 22, a protection layer 21*a* made of heat-resistive glass and having a thickness of 10 microns is applied. They are integrally formed. On the back side of the base plate 21, a temperature detecting element 23 such as a thermister is mounted. The base plate 21 having the heat generating element 22, the protection layer 21*a* and the temperature detecting element 23*a* is securedly mounted on a rigid supporting member 24 through an insulating plate 24*a* made of PI (polyimide) or the like. The heat generating element 22 is provided with power supply electrodes 22*a* and 22*a* at its opposite ends.

During the fixing operation, the temperature of the heater is detected by the thermister 23 functioning as the temperature detecting element, and in response to the detected temperature, the heat generating element 22 is energized by the power supply through the electrodes 22*a* and 22*a* to maintain the temperature of the heater at the optimum fixing temperature. When a heat-fixing toner available from Canon Kabushiki Kaisha, Japan was used, and the temperature of the heater was maintained at 180° C., the heat is sufficiently transferred to the toner image through the fixing film 25 having a total thickness of 35 microns in the fixing nip N portion, so that the image was heat-fixed in good order.

The insulating layer 24*a* is made of resin such as PI having the thermal conductivity of 0.2 J/m.S.K and having a thickness of 3 mm. It serves to prevent the release of the heat from the heater to the supporting member 24. In the heater 20 of this embodiment, the thermal capacity of the heater to be heated by the heat generated by the heat generating element, per unit length, is approximately $7.1\times10^{-2}$ J/Kmm (alumina base plate 21=1 mm$\times$16 mm$\times$1 mm$\times4.4\times10^{-3}$ J/K.mm$^3$: heat generating resistor 22=0.02 mm$\times$2 mm$\times$1 mm$\times4.5\times10^{-3}$ J/K.mm$^3$: and protection layer 21*a*=0.01 mm$\times$16 mm$\times$1 mm$\times2.0\times10^{-3}$ J/K.mm$^3$), which is very small. Therefore, the temperature is quickly heated up to 180° C. with low electric power. Therefore, the quick start with low energy consumption is accomplished.

The inventor's experiments with the fixing device having the structure described above incorporated in an image forming apparatus, have revealed that upon the start of the energization of the fixing apparatus with 300 W electric power, the temperature of the heater has increased up to 180° C. within 5 sec. The image forming apparatus used requires more than 5 sec from the start of the transfer material sheet feed to the introduction into the fixing device 11, and therefore, the image forming operation can be started without starting the preheating from the actuation of the start switch.

In a conventional heat roller type fixing device, the heat generating heater and the heating roller have large thermal capacities, and therefore, it is difficult to reach the fixable temperature within 10 min, so that the user of the image forming apparatus has to wait until the fixable temperature is reached.

In the heater 20 of this embodiment, the PI insulating plate is used for the insulating layer 24*a*. However, by employing the shape of the heat insulating layer 24*a* made of PI, as shown in FIG. 26, that is, the contact surface with the base plate 21 is corrugated to provide an air layer 24*b* in the interface with the base plate 21 to use the heat insulating effect of the air is utilized. By doing so, the temperature increasing speed is further improved With this structure, even when the heater having the alumina base plate 21 having a width of 16 mm and a thickness of 3 mm (the thermal capacity per 1 mm length is $2.18\times10^{-1}$ J/K.mm, and the length is 230 mm, and the total weight is 43 g) is used, the quick start image forming apparatus has been achieved However, preferably, the thermal capacity of the heater is smaller. For example, a heat generating resistor 22 is screen-printed on an alumina base plate 21 having a width of 5 mm and a thickness of 1 mm.

In this embodiment, the surface of the heat generating resistor 22 is coated with a protection layer 21*a* made of heat resistive glass. However, when the portion of the fixing film 25 contacted to the heater 20 is made of non-electric-conductive material, the protection layer may be omitted.

Figure 28:
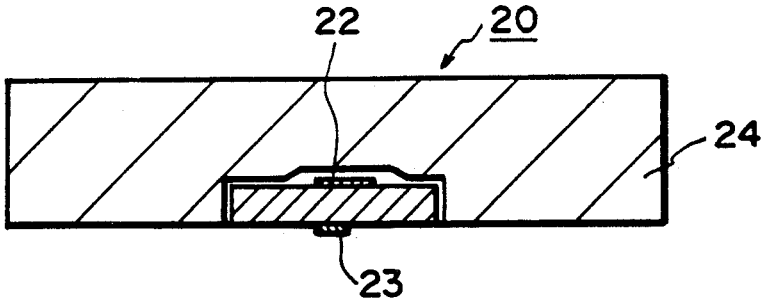

As shown in FIG. 28, the heat generating resistor layer 22 is sandwiched between alumina plates 21 and 21*b* having good thermal conductivity. Even when this structure is employed, the quick start is possible when the thermal capacity per unit length of the heater is not more than $2.2\times10^{-1}$ J/K.mm$^3$.

As shown in FIG. 28, the heat generating element 22 is formed on a side of the heater base plate 21 which is opposite from its side contacting to the fixing film, and a temperature detecting element 23 is formed on the side contacting to the fixing film. By doing so, the temperature can be detected in the heater and adjacent to the fixing film, and therefore, the temperature control is better.

Figure 29:
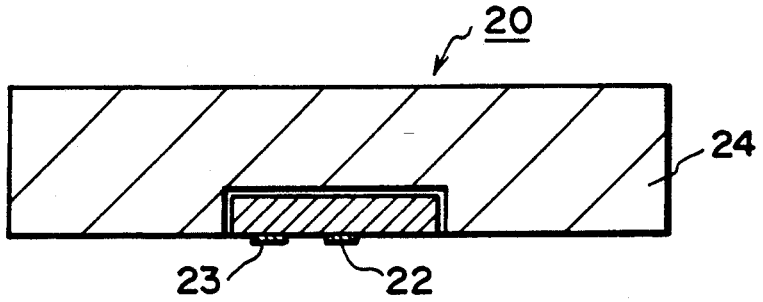

As shown in FIG. 29, both of the heat generating element 22 and the temperature detecting element 23 are formed on the front side of the base plate 21 (the side contacting to the fixing film).

Figure 24A:
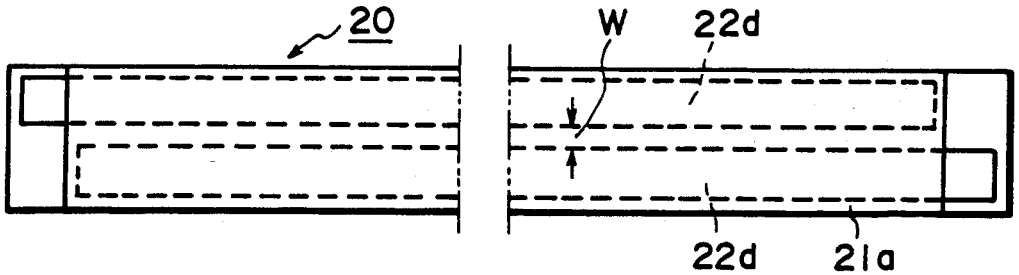
FIGS. 24A and 24B are a top plan view of a heater seen from a sliding surface side and an enlarged sectional view thereof, in a further example.
Figure 24B:
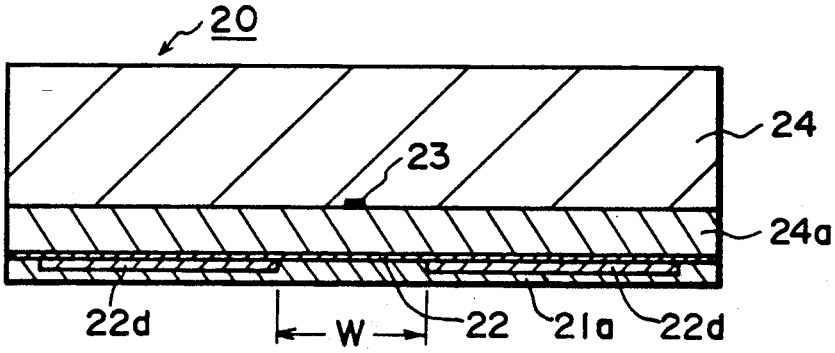
Figure 30A:
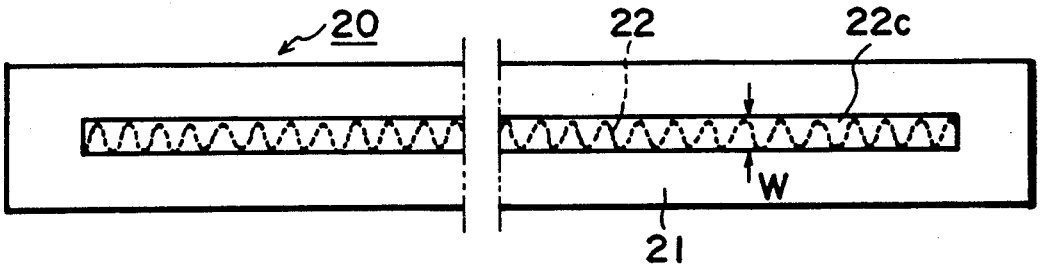
FIGS. 30A, 30B, 31A, 31B and 31C are an enlarged sectional view or a top plan view of a heater illustrating examples of positions of the temperature detecting elements.
Figure 30B:
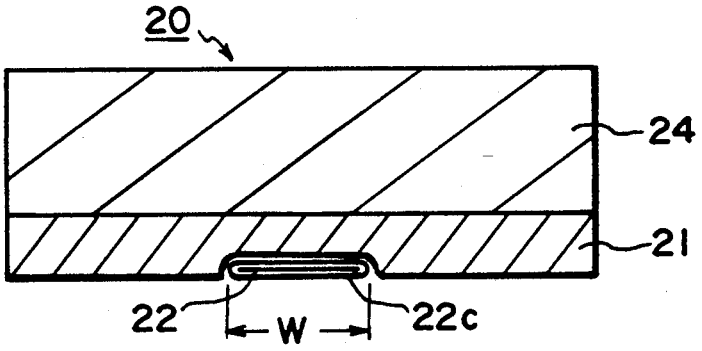

As shown in FIGS. 30A and 30B, the heat generating element 22 may be made of a resistor wire made of nichrome or the like, and it is enclosed with an alumina plate 22*c* in order to provide a larger heating width W. FIG. 24A is a plan view of the side of the heater 20 contacting to the fixing film, and FIG. 24B is an enlarged sectional view.

A yet further embodiment will be described. Since the structure of the heater is similar to that shown in FIG. 24, and therefore, the drawing is omitted for simplicity. In this embodiment, the heater includes an insulating layer 24*a* having a thickness of 0.5 mm and a width of 16 mm and made of heat-resistive glass, a heat generating element 22 (heat generating resistance layer) having a thickness of 5 microns and made of $TaSiO_2$ and formed by sputtering on the surface of the insulating layer, a pair of electrodes 22*d* and 22*d* having a thickness of 2 microns made of gold extended parallel along the length of the heat generating element 22 with a space W therebetween formed on the resistance layer surface for power supply, and a protection layer 21*a* thereon. Having a thickness of 5 microns and made of $Ta_2O_3$. With this structure, the heat generating resistance layer 22 is formed on the insulating layer 24*a*, and therefore, the heater is constituted by the heat generating resistance layer 22, the gold electrodes 22*a* and 22*d* and the protection layer 21*a*. The thermal capacity per unit length is approximately $8.7\times10^{-4}$ J/K.mm (heat resistance layer 22=0.005 mm×16 mm×1 mm×$4.5\times10^3$ J/K.mm$^3$: gold electrodes 22*a*=0.002 mm×7 mm×1×2×$2.5\times10^{-3}$ J/K.mm$^3$: and protection layer 23*a*=0.005 mm×16 mm×1×4.4×10−3 J/k.mm$^3$) which is very small. Therefore, upon energization, the temperature of the heater is increased quickly with further lower power consumption. The experiments using the same toner as in the previous embodiment has revealed that the temperature of the heater has reached to the fixable temperature within 3 sec when 200 W power supply is carried out, in this embodiment.

In this embodiment, the heater has 1/100 thermal capacity as compared with the foregoing embodiment. However, the power consumption is not 1/100. The reasons are that most of the heat generated is used for fixing the unfixed toner image, and that the glass used in the insulating layer 24*a* has a slightly worse heat insulating property as compared with the PPS resin.

However, in this embodiment, the slightly worse heat insulating property of the glass is utilized by predicting the temperature of the heater on the basis of the temperature detected by the thermister 23 (temperature detecting element) contacted to the back side of the insulator 24*a*, and the electric power is supplied to the heat generating element so as to maintain the temperature of the heater at the fixable temperature level.

In this embodiment, when the temperature of the heater is 180° C., the temperature of the backside of the heat insulator 24*a* is approximately 100° C. The temperature difference ΔT between the heater and the backside of the heat insulator is decreased by approximately 5° C. by each of one minute continuous energizations. A table representing a relation among the temperature of the heater, the temperature of the backside of the insulator and the energization time is stored in a ROM, and the energization of the heater to maintain it at the fixing temperature is controlled using a microcomputer containing the ROM.

Figure 31A:
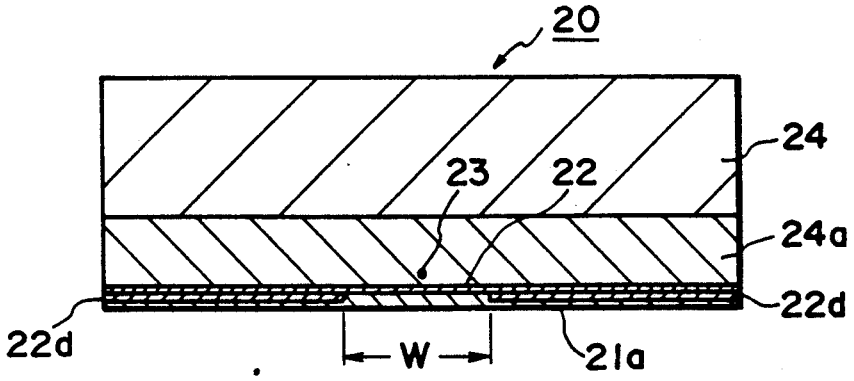
Figure 31B:
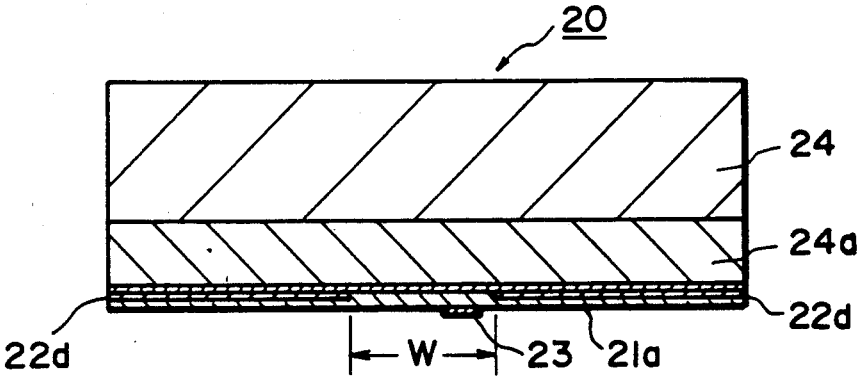
Figure 31C:
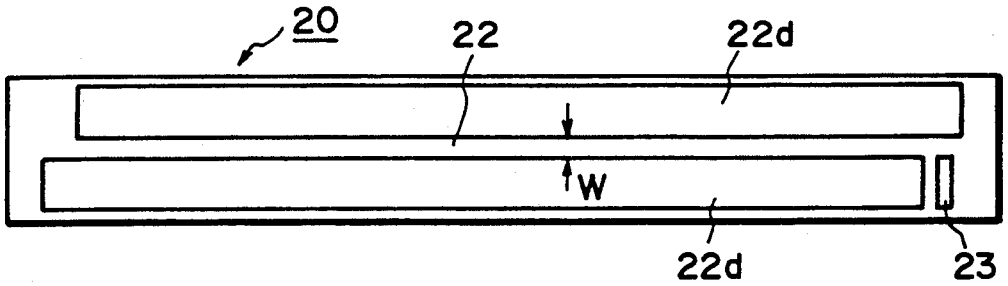

Depending on the individual toners, the temperature has to be accurately detected, and the temperature of the heater is accurately controlled. If this is the case, the temperature may be detected by the accurate temperature detecting means shown in FIGS. 31A, 31B and 31C. In FIG. 31A, the temperature detecting element 23 is planted within the thickness of the insulator 24*a*, by which it is made closer to the heat generating element. In FIG. 31B, the element 23 is mounted on the protection layer 21*a* at a position where the heat is not passed. In FIG. 31C, a material exhibiting different resistance depending on the temperature (PTC property) is evaporated at the end portions, similarly to the gold electrodes, wherein the change in the resistance is detected.

In this embodiment, the heat generating element is directly formed on the heat insulating layer 24*a*, by which the heat generating element is made very small. As shown in FIGS. 25A and 25B, the structure may be such that the heat generating element is the entirety of the heater. That is, the heat generating element 22 of a nichrome wire is fixedly supported at the longitudinal opposites ends on a heater supporting member comprising a heater stay 24 made of metal and a heat insulating plate 24*a* made of PI resin bonded thereon. An electric conductor 22*e* in the form of a spring functions to accommodate the thermal expansion and contraction of the nichrome wire 22 due to the temperature change. The size of the nichrome wire is larger at the marginal portions where the fixing operation is not performed is large to increase the resistance there, thus decreasing the amount of heat generation.

Referring to FIGS. 32A–32D, other embodiments of the heater will be described.

Figure 32A:
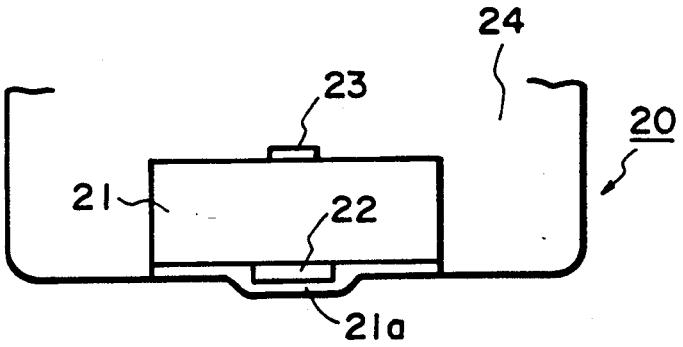
FIGS. 32A, 32B, 32C and 32D and 33 are enlarged sectional views illustrating heaters of further examples.

In FIG. 32A, as a heat generating element 22, Ag/Pd (silver-palladium) resistance layer having a thickness of 10 microns and a width of 1–3 mm is printed on an alumina base plate 21 surface, and as a surface protection layer, heat resistive glass 21*a* having a thickness of not more than 10 microns is applied. They are mounted on a rigid supporting member (heater supporting member) 24 having a low thermal conductivity (insulating material).

Figure 32B:
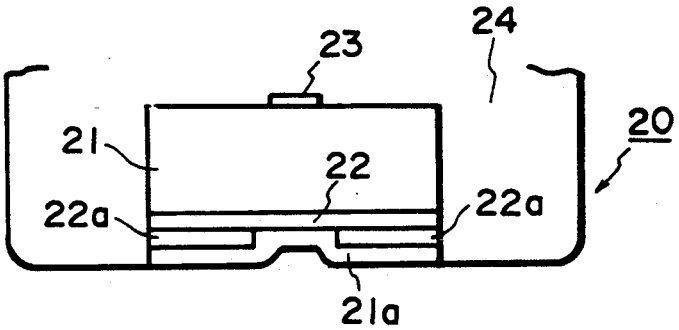

In FIG. 32B, as the heat generating element 22, a heat generating resistance layer of $TaSiO_2$ having a thickness of 0.1 micron is evaporated on a glass base plate 21 surface, and electric power supply electrodes 22*a* are pattern-evaporated, and in addition, as a surface protection layer 21*a*, $Ta_2O_5$ is evaporated in the thickness of approximately 5 microns, and they are mounted on a supporting member 24.

Figure 32C:
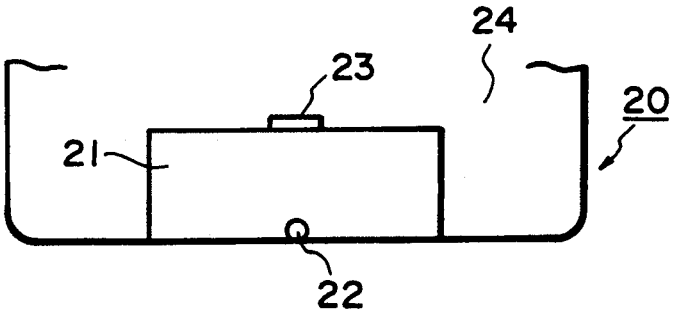

In FIG. 32C, as the heat generating element 22, a nickel-chrome heat generating wire is stretched on an alumina or heat-resistive glass base plate 21, or at last a part of the wire is embedded. They are mounted on the supporting member 24.

Figure 32D:
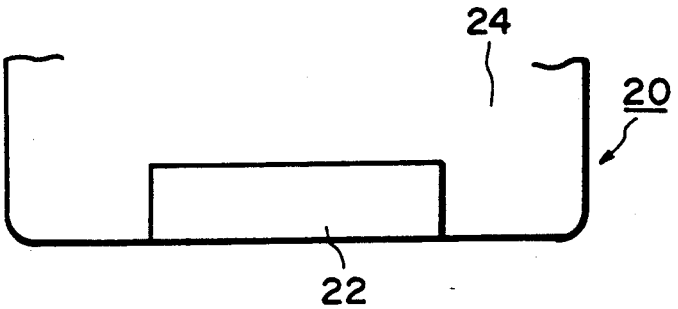

In FIG. 32D, the heat generating element 22 is made of a heat generating member block made of ceramic material or the like, and it is mounted on the supporting member 24, as it is.

The heating portion of the heater 20, that is, the portion mainly composed of the heater base plate 21, the heat generating element 22 and the temperature detecting element 23 has preferably a low thermal capacity from the standpoint of the efficiency of the energy consumption. However, the mechanical strength may be insufficient in view of the pressing force provided by the pressing roller 28. If this is the case, a supporting member 24 is mounted to the heating portion as the reinforcing member to assure the entire mechanical strength of the heater 20.

The supporting member can provide the following advantages in addition to the reinforcing effect:

(1) By making the supporting member 24 from PPS, Bakelite or ceramic which have low thermal conductivity, it can function as the heat insulator description in conjunction with the foregoing embodiment, by which the heat supply to the fixing film is enhanced, and the heat dissipation to other than the heating portion, and the resultant temperature rise, can be prevented.

(2) When the positional accuracy between the fixing nip N and the heat generating element is required, the center of the pressing member and the center of the heat generating element are required to be accurately aligned. It may be difficult to align them when the thermal capacity of the heater is small. If this is the case, the supporting member 24 may be provided with a dimensional reference (for example, a pin) which is effective to increase the positional accuracy.

Figure 33:
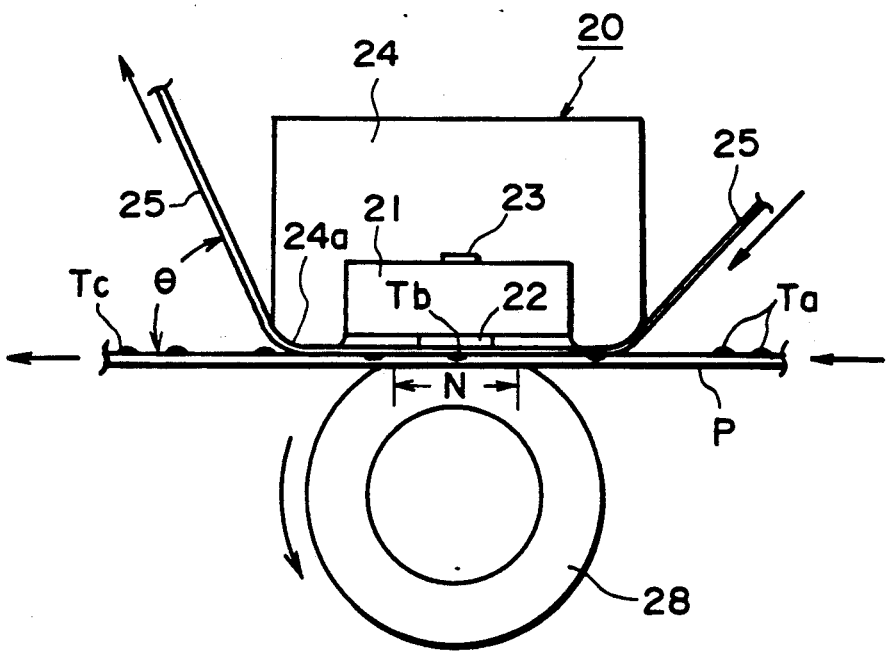

(3) As shown in FIG. 33, the supporting member 24 may also function as a guiding member for the fixing film. As compared with the heater base plate 21, the corner 24*a* can be easily rounded with a smooth surface. When it is used as the guiding member for the sliding movement of the fixing film, the wearing of the fixing film can be prevented or reduced.

On the deflection angle $\theta$ ($0<\theta 180°$) of the sheet P from the fixing film 25 surface after the fixing can be arbitrarily selected. In the inventor's experiments wherein a solid black toner image is formed at the leading edge of a thin sheet (46 g/m$^2$) having a direction of the paper fibers perpendicular to the sheet conveying direction, and the thin paper is subjected to the fixing operation, the sheet P has been prevented from sticking to the fixing film 25 when the deflection angle is not less than 30 degrees. That is, the separating pawl was not required. The tendency for the upward curling which the conventional heating roller has depending on the radius of curvature thereof, has been prevented by making the heating portion (fixing nip N) is made flat and by increasing the separating angle $\theta$ of the fixing film 25.

Figure 34:
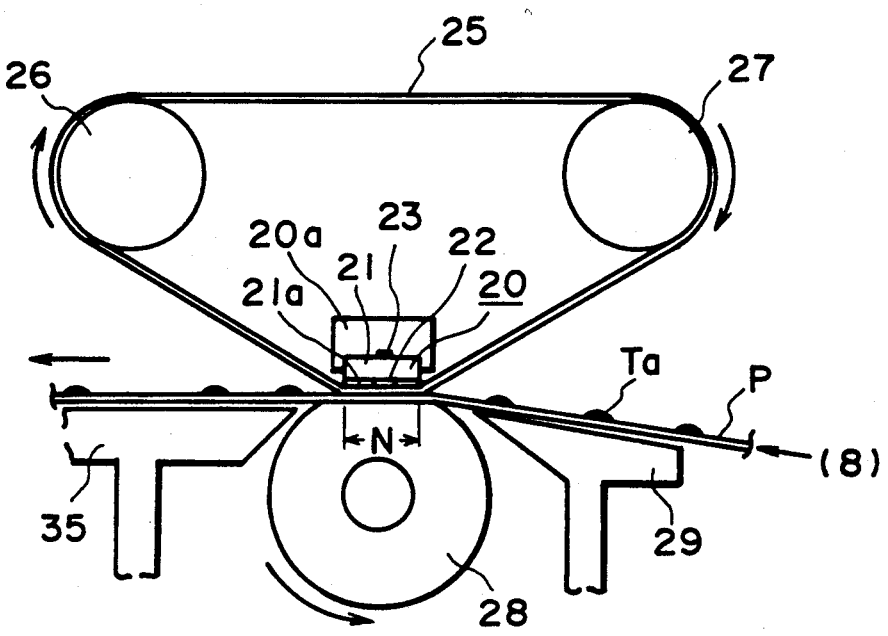
FIGS. 34 and 35 are sectional views of the image fixing apparatuses according to further embodiments of the present invention.
Figure 35:
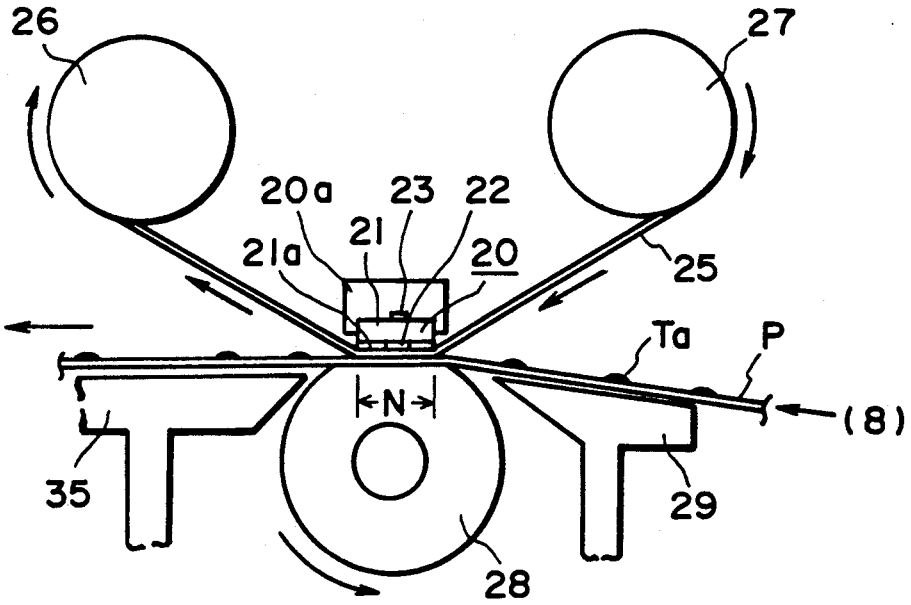

In FIGS. 34 and 35, the heater 20 is a fixed low thermal capacity linear heater. In this embodiment, the heater 20 is extended in the lateral direction of the fixing film (in a direction perpendicular to the travel direction of the fixing film 25). It includes an alumina base plate 21 having a thickness of 1 mm, a width of 10 mm and a length of 240 mm, a linear heat generating resistance layer 22 on the surface thereof (the surface contacting to the fixing film 25), the resistance layer 22 being made of Ag/Pd or the like, and a protection layer 21*a* thereon having a thickness of approximately 10 microns. The protection layer is made of heat resistive glass and has a smooth surface. To the backside of the heater 21, a temperature detecting element 23 such as a thermister is mounted. On the basis of the temperature detected by the temperature detecting element 23, the power supply to the linear heat generating resistance layer 22 is controlled.

The heater 20 is supported on a heat insulative rigid supporting member 20*a* made of heat resistive resin such as polyphenylene sulfide, polyamide imide, or polyimide. They are fixed on the fixing device by an unshown metal supporting table.

Figure 36:
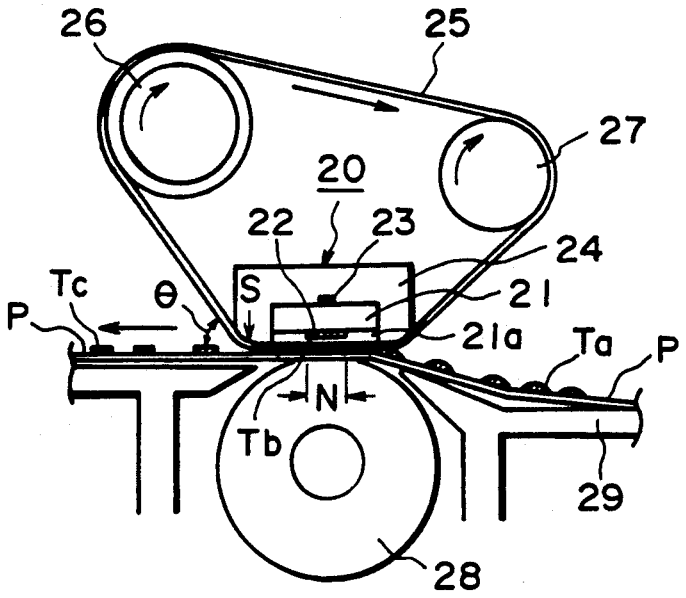
FIG. 36 is a sectional view of an image fixing apparatus according to a further embodiment of the present invention.
Figure 37:
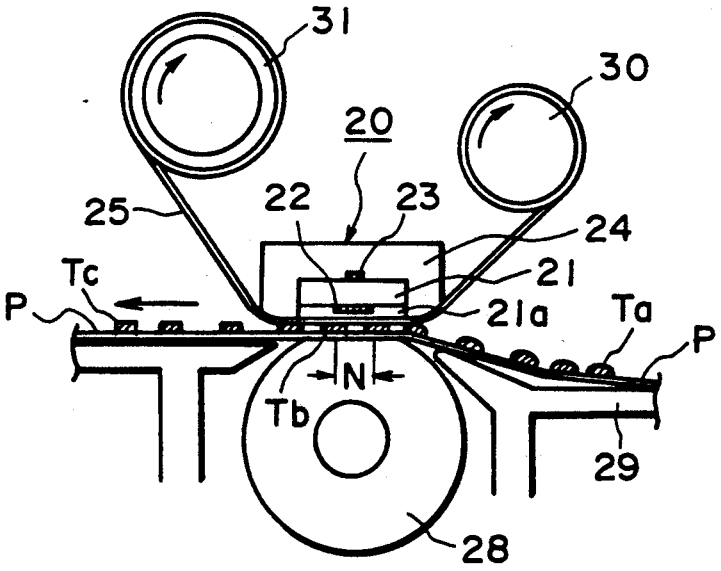
FIGS. 37 are sectional views of image fixing apparatuses according to further embodiments of the present invention.

FIGS. 36 and 37 show further embodiments. Those embodiments are self-explanatory for one skilled in the art by referring to those Figures without particular description, when the foregoing descriptions are considered. Therefore, the detailed descriptions are omitted for simplicity.

The description will be made further as to the fixing film 25 used in this embodiment.

Figure 38:
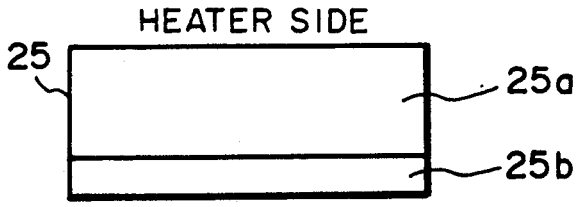
FIGS. 38–42 are sectional views of a fixing film used in the image fixing apparatuses according to the present invention.

FIG. 38 shows the section of the laminated structure of the fixing film 25. A heat resistive layer 25*a* is a base layer (base film) of the fixing film 25, and it has a good mechanical strength. The bottom surface of this layer is contacted to the heater 20. A releasing layer 25*b* is laminated on the outer surface of the heat resistive layer (the surface contactable to the toner image).

The heat resistive layer 25*a* has a thickness of 18 microns and is made of polyimide. The other usable materials are highly heat resistive resin such as polyether ether ketone (PEEK), polyether sulfone (PES), polyether imide (PEI), polyparabonic acid (PPA), or metal such as Ni, SUS, Al (which are good in the mechanical strength and the heat resistivity). The heat resistive layer 25*a* is a seamless cylinder provided by casting method using a cylindrical mold in this embodiment using polyimide. The method of providing the seamless cylinder is not limited to this. For example, a polyimide film sheet is bonded to provide the cylindrical form, and then the bonded portion is abraded. In the case of the thermoplastic resin such as PES, the seamless cylinder can be provided by implantation method. When metal such as Ni is used, the seamless cylinder can be provided by an electroforming method.

The releasing layer 25*b* is made of polytetrafluoroethylene (PTFE) having a thickness of 7 microns. Other usable materials are fluorine resin such as PFA or FEP or silicone resin such as RTV silicone rubber having good releasing property relative to the toner.

The method of the laminated releasing layer 25*b* on the heat resistive layer 24*a* will be described. Dispersion liquid containing PTFE particles is applied uniformly on the heat-resistive layer 25*a* by a spray method, and is dried and sintered. During the sintering, the releasing layer 25*b* made of PTFE is thermally contracted, and therefore, there is a liability that the fixing film 25 is deformed. In order to avoid this problem, the thickness of the heat-resistive layer 25*a* is larger than the thickness of the releasing layer 25*b*. The method of formation of the releasing layer 25*b* is not limited to the above-described. For example, the dispersion liquid containing the PTFE resin particles may be applied by a dipping method, a roll coating method or an electrostatic painting method. In place of using the dispersion liquid containing the PTFE particles, the releasing layer 24*b* may be formed by a CVD method or a vacuum evaporation method. Alternatively, a releasing layer film may be laminate-bonded on the surface of the heat-resistive layer 25*a*. In that case, the releasing layer 25*b* in the form of a seamless cylinder may be covered on the outer surface of the heat-resistive layer 25*a* in the form of seamless cylinder, and is heat-bonded. Further alternatively, the outer surface of the heat-resistive layer 25*a* in the form of a seamless cylinder is covered with the releasing layer 25*b* in the form of a sheet, and is heat-bonded. In the latter case, the connecting seam of the releasing layer 25 may be made substantially in the seamless form by using a thermoplastic material having low viscosity when fused. Further alternatively, a heat-resistive layer 25*a* sheet and a releasing layer 25*b* sheet are first laminate-bonded, and thereafter, they are bonded into a cylinder, and thereafter, the connecting portion is treated or the seamless cylinder.

The thickness of the fixing film 25 in this embodiment is preferably thin so as not to impede the heat transfer from the heater, and is preferably not more than 100 microns, and further preferably not more than 40 microns. However, if it is too thin, it becomes difficult to drive the fixing film without production of crease, and therefore, the thickness of the heat-resistive layer is not less than 6 microns, further preferably not less than 12.5 microns.

In the fixing film 25 of this embodiment, the so-called pencel hardness of the releasing layer (JIS K5400) (500 g)) is 4*b*–9*h*, the preferably Hb–9*h* at normal temperature. At 200° C., it is preferably 5*b*–9*h*, and further preferably 2*b*–9*h*. In order to provide sufficient bonding strength to meet the above pencil hardness, the surface of the heat resistive layer is treated for rough surface by agent such as or corona discharging. Examples and Comparison Examples of the fixing film will be described.

Comparison Example 1*a*

The fixing film made only of polyimide was used. The surface energy of the polyimide is large, and therefore, a small amount of toner was off-set to the fixing film. Since the recording material and the film were separated when the temperature of the toner is higher than the glass transition point, particularly higher than the softening point, and therefore, the amount of toner off-set was large when the film was made only of the polyimide resin.

Comparison Example 1*b*

The fixing film was made only of fluorine resin such as PFA or PTFE. The fixing film was thermally contracted by the heating from the heater. Since the fixing film was sliding on the heater while the temperature thereof was high, the wearing of the sheet was significant with the result of insufficient durability.

EXAMPLE 1*b*

When the fixing film 25 is of plural layers, they can be separated if the bonding strength therebetween is not sufficient. In consideration of this, in FIG. 39 embodiment, a bonding layer 25*c* made of fluorine resin is provided between the heat resistive layer 25*a* and the releasing layer 25*b*.

In the example wherein the heat-resistive layer 25*a* had a thickness of 18 microns and was made of polyimide, and the releasing layer 25*b* had a thickness of 7 microns and was made of PTFE, the pencil hardness was HB. When the bonding layer 25*c* containing the fluorine resin having a thickness not less than 1 micron, preferably not less than 3 microns, the pencil hardness is improved up to 3H.

Alternatively, the material of the releasing layer 25*b* is a film in the form of a sheet or a seamless tube made of fluorine resin such as PFA, and the bonding layer 25*c* is provided between itself and the heat-resistive layer 25*a* of polyimide or the like, by which the releasing layer 25*b* and the heat-resistive layer 25*c* are heat-bonded.

The fluorine resin film is good in the surface smoothness, and therefore, the off-set preventing effect can be enhanced, and in addition, the strength of the releasing layer becomes strong. Therefore, it is particularly effective for the case of low fixing speed and the case of a large heat generation amount by the heat generating element.

EXAMPLE 1*c*

As described, by the provision of the bonding layer, the contact between the layers is improved. From the standpoint of the thermal response of the fixing film, the thermal capacity of the fixing film is desirably low. This is particularly so, when the heater is energized pulsewisely, as disclosed in Japanese Laid-Open Patent Application No. 313182/1988.

Figure 40:
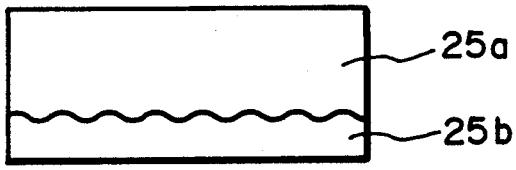

In FIG. 40 embodiment, the contact between the heat-resistive layer 25*a* and the releasing layer 25*b* is improved without provision of the bonding layer. In this embodiment, the surface of the heat-resistive layer 25*a* is roughened, and the releasing layer 25*b* is coated on the roughened surface. Because the bonding layer is not employed in this embodiment, the thermal capacity of the fixing film is not increased, and therefore, it is particularly effective when the heat generating element is pulsewisely energized.

EXAMPLE 1*d*

Figure 41:
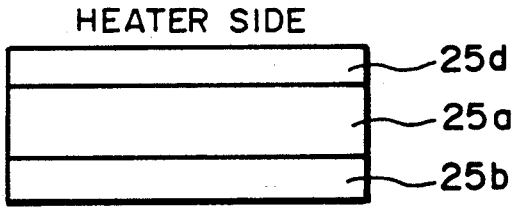

In FIG. 41, the heater side of the heat resistive layer 25*a* is provided with a sliding layer 25*d* having a good sliding property. In this structure, the frictional resistance between the fixing film and the heater is reduced, by which the driving force for the sheet is reduced, and the travel of the sheet can be stabilized. Therefore, this is particularly effective when the heater and the sheet are relatively slid.

EXAMPLE 1*e*

Figure 42:
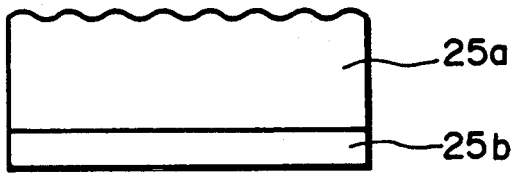

FIG. 42 shows an example by which the friction between the sheet and the heater is reduced without increasing the thermal capacity of the sheet. In this example, the surface of the sheet which is in sliding contact with the heater is roughened to reduce the actual contact area between the sheet and the heater.

EXAMPLE 1*f*

When the releasing layer 25*b* or the sliding layer 25*d* require a further high hardness, a high hardness material such as titanium oxide or titanium nitride may be added into the layer.

In the examples described above, the mechanical strength and the heat resistivity of the entire fixing film is provided by the heat-resistive layer 25*b*, and the releasing property relative to the toner is assured by the provision of the releasing layer 25*d*, and therefore, it is good in the durability and the off-set preventing effect.

When the heat resistive layer is made of a highly heat resistive resin such as polyimide, the fixing film is electrically charged with the result that the unfixed toner image is disturbed by the electrostatic force during the fixing operation, as the case may be. If this occurs, the above-described high off-set preventing effect is deteriorated. In addition, when the fixing film is electrically charged, and the surface potential thereof is increased, an electric discharge is produced between itself and another part of the apparatus with the result of noise production. If this occurs, there is a liability that the control circuit in the microcomputer or the like is erroneously operated.

The description will be further made as to an example, by which the electric charging of the fixing film can be prevented. The surface layer of other than the heat resistive layer 25*a*, particularly at least the releasing layer 25*b* is treated for low electric resistance.

EXAMPLE 1*g*

The releasing layer 25*b* in this example is a PTFE layer in which carbon particles or fibers such as carbon black, Ketchen black or graphite to make the volume resistivity of the PTFE layer $10^8$ ohm.cm.

Because the resistance is low, the electric charging of the fixing film is prevented, so that the unfixed toner image is prevented from being disturbed by the electrostatic force. In addition, the attraction of foreign matters by the sheet is prevented. If the foreign matters are attracted on the sheet, the releasing property is deteriorated, and the pressing roller 28 is damaged.

Where the fixing film 25 is not endless one, and is in the take-up type shown in FIG. 37, since the fixing film is overlapped the high resistance surface side of the fixing film is contacted to the low resistance side, by which the electric charge is dissipated. That is, if only one of the surface of the fixing layer is low in the electric resistance, the charge preventing effect on the surface of the fixing film contactable to the toner image can be more or less provided. However, it is preferable that the resistance of the surface layer of the toner is reduced.

Further, when the fixing film is in sliding contact with the heater, as shown in FIG. 36, a foreign matter is present between the heater 20 and the heater side surface of the fixing film due to the charging, with the result of the damage of the fixing film and the heater. In this embodiment, this problem can be solved.

Figure 43:
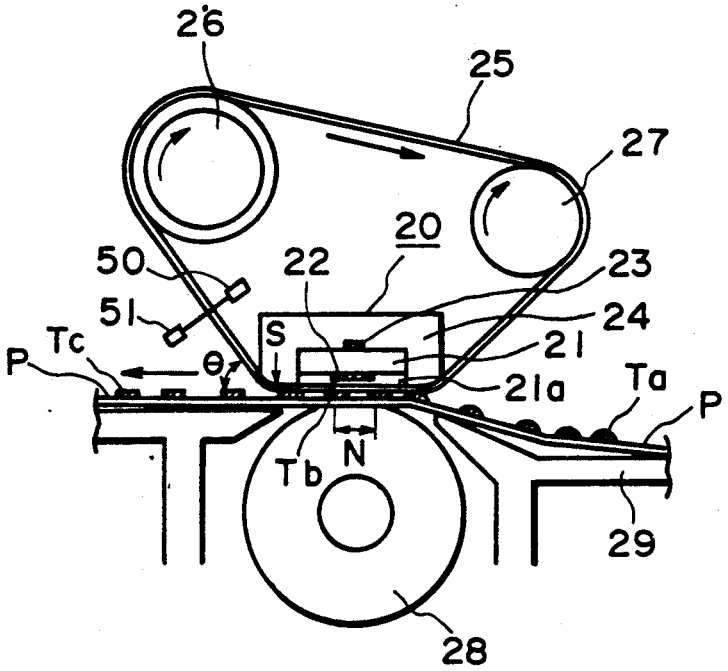
FIG. 43 is a sectional view of an image fixing film of another example.

In order to assure the charge preventing effect for the both sides of the fixing film, it is preferable that the electric resistance at each of the surfaces of the fixing film is reduced. Similarly to FIG. 43 embodiment, a layer is added to the heater side of the heat resistive layer of the sheet, and the added layer is treated for the low resistance.

Alternatively, the low resistance filler material such as carbon black is added in the heat resistive layer to reduce the charging. However, it reduces the heat resistivity and the mechanical strength of the heat resistive layer, and it is further preferable that the filler is not added in the heat resistive layer.

The low resistance layer has a volume resistivity of $10^{11}$ ohm.cm or lower to provide the charge preventing effect. Particularly, the charge preventing effect is further assured if it is $10^9$ ohm.cm or lower.

The low resistance filler material is not limited to the carbon material, but may be titanium nitride, potassium nitride, copper or iron oxide red.

The releasing layer 25*b* and the sliding layer 25*d* of the endless fixing film were made of PTFE having the volume resistivity of $10^{15}$ ohm.cm or higher without the low resistance filler material such as carbon black. Using this sheet, the fixing operation was continuously repeated for a long period of time. The fixing film was electrically charged, with the result that foreign matters were attracted on the fixing film, that the unfixed toner image on the recording medium was disturbed, and that the electric discharge occurred between itself and a grounded part, by which the control circuit including the microcomputer was erroneously operated.

The reasons for this are considered as follows:

(1) The fixing film 25 is electrically charged by peeling discharge at the time when the fixing film 25 is separated from the recording medium by the supporting member 24:

(2) The fixing film 25 is electrically charged by the rolling frictional charging and peeling charging at the time when it is driven by the driving roller 26 and the follower roller 27: and (3) The fixing film 25 is electrically charged by the frictional charging by the sliding contact with the heater 20.

EXAMPLE 1*h*

The used low resistance filler material was titanium oxide whisker material which is a single crystal fibers having electric conductivity (volume resistivity is $10^4$ ohm.cm). By the introduction of the conductive whisker fibers, the electric charging was prevented, and in addition, the wearing is reduced because the whisker material has high hardness. Thus, the durability of the fixing film is further improved.

EXAMPLE 1*i*

Figure 39:
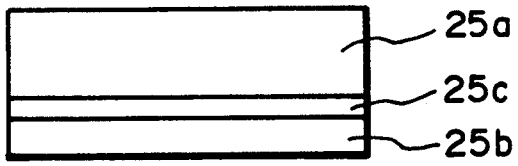

In the structure of Example 1*a*, a sheet discharging means 50 and 51 for electrically discharging the sheet (discharging brush made of carbon fiber or the like, for example) were contacted to the film as shown in FIG. 39. By doing so, the charge preventing effect of the fixing film is further improved, and in addition, the high charge preventing effect can be provided even if the amount of the low resistance filler material is reduced.

The discharging means may be provided at only one side. The discharging effect is improved by making the driving roller 26 and the follower roller 27 with a conductive material such as metal.

The endless fixing film is not limited to the seamless cylinder, but it may be in the form of a cylinder having a seam. In that case, the peripheral length of the cylinder is larger than the length of the usable sheet P. By doing so, the seam is not contacted to the sheet P if the sheet is conveyed at a predetermined timing.

As described in the foregoing, according to the present invention, the fixing film is good in the mechanical strength, the durability and the releasing property, and therefore, the good fixing operation is possible for a long period of time.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus, comprising:
a heater having a heating surface;
a base member for supporting said heater, said base member having an edge;
a holder for supporting said base member;
a film movable with a recording material in sliding contact with the heating surface;
wherein said holder has a rounded projection for preventing contact of said film with the edge.

2. An apparatus according to claim 1, wherein said base member is of ceramic material

3. An apparatus according to claim 1, wherein said base member has a high thermal conductivity and is provided on a side thereof opposite from a side supporting said heater with a temperature detecting element for controlling the power supply to said heater.

4. An apparatus according to claim 1, wherein said holder is of thermally insulating material.

5. An apparatus according to claim 1, wherein said base member has edges at its ends in a movement direction of said film, and said holder has projections at its opposite ends.

6. An apparatus according to claim 1, wherein said projection project beyond the edges toward said film.

7. An apparatus according to claim 1, further comprising an urging member for urging said heater, said film and the recording material.

8. An apparatus according to claim 1, wherein said image is a powder toner image, and wherein a temperature of toner constituting the toner image at a point where the recording medium is separated from said film is higher than a glass transition point of the toner.

9. An apparatus according to claim 1, wherein said film has a thickness not more than 100 microns.

10. An apparatus according to claim 9, wherein said film has a thickness not more than 40 microns.

11. An apparatus according to claim 1, wherein said film is in the form of an endless belt.

12. An apparatus according to claim 1, wherein said film is of heat resistive resin material.

13. An apparatus according to claim 1, wherein said holding member is of molded resin material.

14. An apparatus according to claim 1, wherein said apparatus heat-fixing the image on the recording material.

15. An apparatus according to claim 2, wherein the ceramic material is alumina.

16. An apparatus according to claim 3, wherein said temperature detecting element is between said base member and said holder.

17. An image heating apparatus, comprising:
a heater having a heating surface;
a base member for supporting said heater, said base member having an edge;
a film movable with a recording material in a sliding contact with the heating surface;
projection member mounted on said base member for preventing contact of said film with the edge.

18. An apparatus according to claim 17 wherein said base member has edges at its ends in a movement direction of said film, and said projection members is provided at opposite sides of said base member.

19. An apparatus according to claim 17, wherein said projection members project beyond the edges toward said film.

20. An apparatus according to claim 17, further comprising an urging member for urging said heater, said film and the recording material.

21. An apparatus according to claim 17, wherein said image is a powder toner image, and wherein a temperature of toner constituting the toner image at a point where the recording medium is separated from said film is higher than a glass transition point of the toner.

22. An apparatus according to claim 17, wherein said film has a thickness not more than 100 microns.

23. An apparatus according to claim 17, wherein said film has a thickness not more than 40 microns.

24. An apparatus according to claim 17, wherein said film is in the form of an endless belt.

25. An apparatus according to claim 17, wherein said film is of heat resistive resin material.

26. An apparatus according to claim 17, wherein said apparatus heat-fixing the image on the recording material.

27. An apparatus according to claim 17, wherein said base member is of ceramic material.

28. An apparatus according to claim 27, wherein the ceramic material is alumina.

29. An image heating apparatus, comprising:
a heating block including a heat generating resistor for generating heat upon electric power supply thereto, and a base member, having a rectangular cross-section, for supporting said heat generating resistor;
a film movable with a recording material in sliding contact with the heating block, said film contacting said heating block at a central portion of said base member and not contacting said heating block at end portions thereof with respect to a movement direction of said film.

30. An apparatus according to claim 29, further comprising a holder for insulatively holding said heating block, said holder having a guiding portion for guiding said film with a gap from said heating block at the end portion of said base member

31. An apparatus according to claim 30, wherein said holder is of thermally insulating material.

32. An apparatus according to claim 30, wherein said holding member is of molded resin material.

33. An apparatus according to claim 29, wherein said base member is of ceramic material.

34. An apparatus according to claim 33, wherein the ceramic material is alumina.

35. An apparatus according to claim 29, wherein said base member has a high thermal conductivity and is provided on a side thereof opposite from a side supporting said heat generating resistor with a temperature detecting element for controlling the power supply to said heat generating resistor.

36. An apparatus according to claim 29, further comprising an urging member for urging said heater, said film and the recording material.

37. An apparatus according to claim 29, wherein said image is a powder toner image, and wherein a temperature of toner constituting the toner image at a point where the recording medium is separated from said film is higher than a glass transition point of the toner.

38. An apparatus according to claim 29, wherein said film has a thickness not more than 100 microns.

39. An apparatus according to claim 38, wherein said film has a thickness not more than 40 microns.

40. An apparatus according to claim 29, wherein said film is in the form of an endless belt.

41. An apparatus according to claim 29, wherein said film is of heat resistive resin material.

42. An apparatus according to claim 29, wherein said apparatus heat-fixing the image on the recording material.

43. An image heating apparatus, comprising:

a heater having a heating surface;

a base member for supporting said heater;

a film movable with a recording material in sliding contact with the heating surface;

a projection portion, beyond said base member toward said film, for guiding movement of said film;

wherein said heater, said base member and said projecting portion provide a convex portion.

44. An apparatus according to claim 43, wherein said heater, said base member, said projection portion and said film provide a closed region in a cross-section along a movement direction of said film.

45. An apparatus according to claim 43, further comprising a holder for supporting said base, and said holder having a projection portion.

46. An apparatus according to claim 43, wherein said projecting portion is provided at each of upstream and downstream sides of said heating surface with respect to a movement direction of said film, and wherein the convex region is also provided at each of the sides.

47. An apparatus according to claim 45, wherein said holder is of thermally insulating material.

48. An apparatus according to claim 45, wherein said holding member is of molded resin material.

49. An apparatus according to claim 43, wherein said base member is of ceramic material.

50. An apparatus according to claim 49, wherein the ceramic material is alumina.

51. An apparatus according to claim 43, wherein said base member has a high thermal conductivity and is provided on a side thereof opposite from a side supporting said heater with a temperature detecting element for controlling the power supply to said heater.

52. An apparatus according to claim 43, further comprising an urging member for urging said heater, said film and the recording material.

53. An apparatus according to claim 43, wherein said image is a powder toner image, and wherein a temperature of toner constituting the toner image at a point where the recording medium is separated from said film is higher than a glass transition point of the toner.

54. An apparatus according to claim 43, wherein said film has a thickness not more than 100 microns.

55. An apparatus according to claim 54, wherein said film has a thickness not more than 40 microns.

56. An apparatus according to claim 43, wherein said film is in the form of an endless belt.

57. An apparatus according to claim 43, wherein said film is of heat resistive resin material.

58. An apparatus according to claim 43, wherein said apparatus heat-fixing the image on the recording material.

59. An image heating apparatus, comprising:

a heater having a heating surface;

a base member for supporting said heater;

a heat-insulative holder for supporting said base member;

a film movable with a recording material in sliding contact with the heating surface;

wherein said holder has a channel-like portion, where said base member is supported.

60. An apparatus according to claim 59, wherein said channel-like portion has a depth which is larger than a thickness of said base member.

61. An apparatus according to claim 60, wherein said base member has a rectangular cross-section.

62. An apparatus according to claim 59, wherein said temperature detecting element is mounted on said base member to detect a temperature of said base member, wherein said holder covers said temperature detecting element.

63. An apparatus according to claim 59, wherein said film is of resin material, and said heater and said base member are enclosed by said film and said holder.

64. An apparatus according to claim 62, wherein said film is of resin material, and said heater, said base member and said temperature detecting element are enclosed by said film and said holder.

65. An apparatus according to claim 59, wherein said base member is thermally conductive.

66. An apparatus according to claim 65, wherein a temperature detecting element for detecting a temperature of said base member to control power supply to said heater is mounted on aside of said base member remote from said heater.

67. An apparatus according to claim 59, wherein said base member is of ceramic material.

68. An apparatus according to claim 67, wherein the ceramic material is alumina.

69. An apparatus according to claim 59, further comprising an urging member for urging said heater, said film and the recording material.

70. An apparatus according to claim 59, wherein said image is a powder toner image, and wherein a temperature of toner constituting the toner image at a point where the recording medium is separated from said film is higher than a glass transition point of the toner.

71. An apparatus according to claim 59, wherein said film has a thickness not more than 100 microns.

72. An apparatus according to claim 71, wherein said film has a thickness not more than 40 microns.

73. An apparatus according to claim 59, wherein said film is in the form of an endless belt.

74. An apparatus according to claim 59, wherein said holding member is of molded resin material.

75. An apparatus according to claim 59, wherein said apparatus heat-fixing the image on the recording material.

76. An apparatus according to claim 17, wherein said projection member is rotatable.

* * * * *

UNITED STATES PATENT AND TRADEMARK OFFICE

CERTIFICATE OF CORRECTION

PATENT NO. : 5,162,634

DATED : November 10, 1992

INVENTOR(S) : KUSAKA et al.

It is certified that error appears in the above-identified patent and that said Letters Patent is hereby corrected as shown below:

Title page, item

[30] FOREIGN APPLICATION PRIORITY DATA

"64-076253" should read --1-076253--.
"64-160271" should read --1-160271--.

COLUMN 2

Line 45, "fixing" should read --image fixing--.

COLUMN 3

Line 47, "constitute" should read -- constitutes--.
Line 49, " slid" should read --slit--.

COLUMN 4

Line 12, "leading" should read --leading edge--.
Line 24, "tray" should read --tray 12--.

COLUMN 7

Line 45, "an" should read --and--.

UNITED STATES PATENT AND TRADEMARK OFFICE

CERTIFICATE OF CORRECTION

PATENT NO. : 5,162,634

DATED : November 10, 1992

INVENTOR(S) : KUSAKA et al.

It is certified that error appears in the above-identified patent and that said Letters Patent is hereby corrected as shown below:

COLUMN 11

Line 4, "light" should read --right--.

COLUMN 13

Line 47, "sticks" should read --sticking--.

COLUMN 14

Line 30, "exist" should read --exists--.

COLUMN 15

Figure 11:
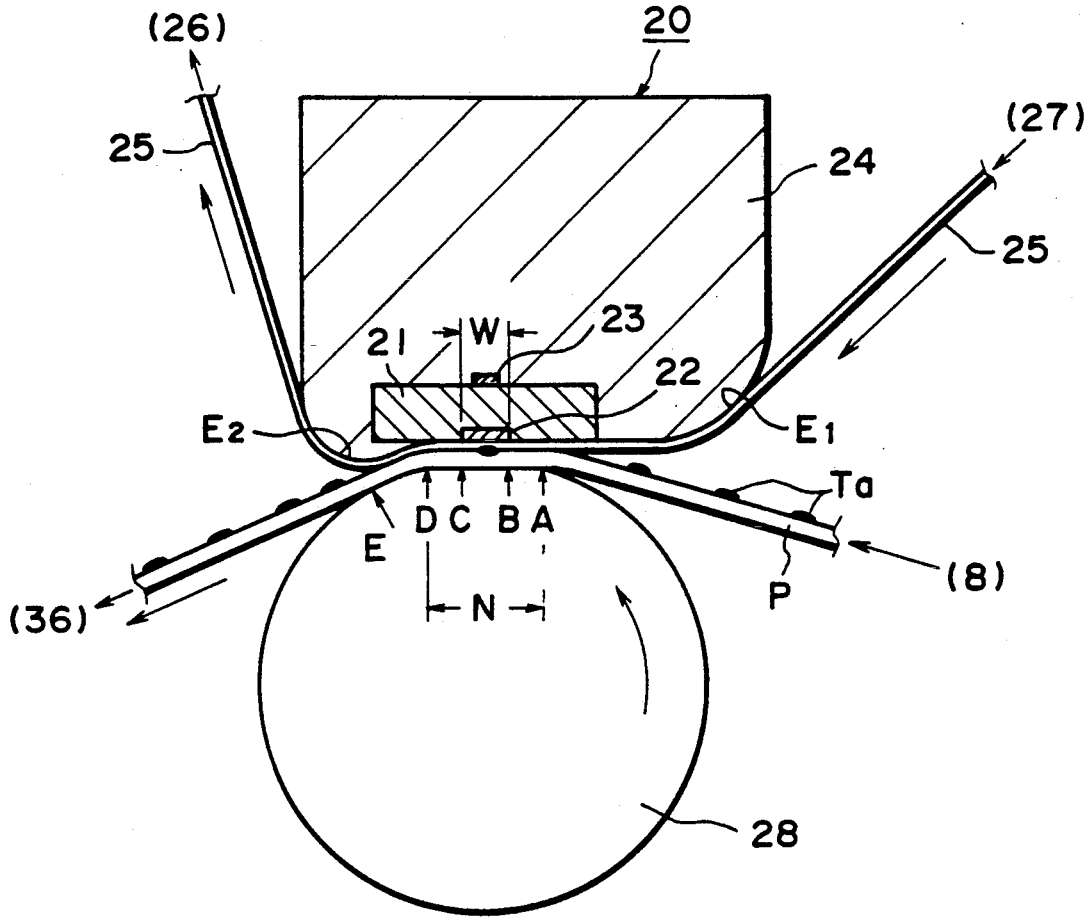
FIGS. 11–14 are sectional views of fixing apparatuses according to further embodiment of the present invention.

Line 3, "FIG. 1," should read --FIG. 11,--.
Line 4, "described In" should read --described. In--.
Line 58, "vides" should read --vide--.

COLUMN 16

Line 31, "40," should read --41,--.

UNITED STATES PATENT AND TRADEMARK OFFICE

CERTIFICATE OF CORRECTION

PATENT NO. : 5,162,634

DATED : November 10, 1992

INVENTOR(S) : KUSAKA et al.

It is certified that error appears in the above-identified patent and that said Letters Patent is hereby corrected as shown below:

COLUMN 19

Line 14, "21a the" should read --21a. The--.
Line 59, "save" should read --saving--.

COLUMN 20

Line 8, "secondary" should read --secondly--.

COLUMN 21

Line 56, "an opposite" should read --an insulating plate 24a made of PI or the like. At the opposite--.

COLUMN 22

Line 15, "required" should read --require--.
Line 64, "described FIGS." should read --described. FIGS.--.

COLUMN 23

Line 49, "0.5 mm" should read --0.5 mm,--.

UNITED STATES PATENT AND TRADEMARK OFFICE

CERTIFICATE OF CORRECTION

PATENT NO. : 5,162,634

DATED : November 10, 1992

INVENTOR(S) : KUSAKA et al.

It is certified that error appears in the above-identified patent and that said Letters Patent is hereby corrected as shown below:

COLUMN 25

Line 11, "improved" should read --improved.--.
Line 66, "thereon. Having" should read --thereon, having--.

COLUMN 26

Line 6, "4.5 x $10^3$" should read --4.5 x $10^{-3}$--.
Line 8, "10-3" should read --$10^{-3}$--.
Line 65, "opposites" should read --opposite--.

COLUMN 28

Line 3, "(0<$\theta$180°)" should read --(0<$\theta$<180°)--.

COLUMN 29

Line 43, "or" should read --for--.
Line 54, "pencel" should read --pencil--.

UNITED STATES PATENT AND TRADEMARK OFFICE

CERTIFICATE OF CORRECTION

PATENT NO. : 5,162,634

DATED : November 10, 1992

INVENTOR(S) : KUSAKA et al.

It is certified that error appears in the above-identified patent and that said Letters Patent is hereby corrected as shown below:

COLUMN 30

Line 51, "wisely," should read --wise,--.
Line 62, "pulsewisely" should read --pulsewise--.

COLUMN 31

Line 61, "surface" should read --surfaces--.

COLUMN 33

Line 46, "project" should read --projects--.

COLUMN 34

Line 16, "members" should read --member--.
Line 38, "heat-fixing" should read --heat-fixes--.

COLUMN 35

Line 24, "heat-fixing" should read --heat-fixes--.

UNITED STATES PATENT AND TRADEMARK OFFICE

CERTIFICATE OF CORRECTION

PATENT NO. : 5,162,634 Page 6 of 6

DATED : November 10, 1992

INVENTOR(S) : KUSAKA et al.

It is certified that error appears in the above-identified patent and that said Letters Patent is hereby corrected as shown below:

COLUMN 36

Line 9, "heat-fixing" should read --heat-fixes--.
Line 41, "aside" should read --a side--.
Line 64, "heat-fixing" should read --heat-fixes--.

Signed and Sealed this

First Day of February, 1994

Bruce Lehman

*Attest:*

BRUCE LEHMAN

*Attesting Officer*

*Commissioner of Patents and Trademarks*